US011692146B1

(12) United States Patent
Ding et al.

(10) Patent No.: US 11,692,146 B1
(45) Date of Patent: Jul. 4, 2023

(54) SYSTEMS AND PROCESSES FOR UPGRADING CRUDE OIL THROUGH HYDROCRACKING AND SOLVENT ASSISTED ON-LINE SOLID ADSORPTION OF ASPHALTENES

(71) Applicant: Saudi Arabian Oil Company, Dhahran (SA)

(72) Inventors: Lianhui Ding, Dhahran (SA); Sameer A. Al-Ghamdi, Dhahran (SA); Faisal Alotaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/567,440

(22) Filed: Jan. 3, 2022

(51) Int. Cl.
*C10G 67/06* (2006.01)
*C10G 47/00* (2006.01)
(Continued)

(52) U.S. Cl.
CPC ..... *C10G 67/06* (2013.01); *C10G 25/003* (2013.01); *C10G 25/12* (2013.01); *C10G 45/00* (2013.01);
(Continued)

(58) Field of Classification Search
CPC ..... C10G 67/06; C10G 25/003; C10G 25/12; C10G 45/00; C10G 47/00;
(Continued)

(56) References Cited

U.S. PATENT DOCUMENTS 5,190,633 A * 3/1993 Fetzer ..... C10G 67/06 208/48 R
6,217,746 B1 * 4/2001 Thakkar ..... C10G 65/12 208/100
(Continued)

FOREIGN PATENT DOCUMENTS

CN 1243083 C 2/2006
CN 113817496 A 12/2021
(Continued)

OTHER PUBLICATIONS

Ashtari et al. "Asphaltene removal from crude oil by means of ceramic membranes" Journal of Petroleum Science and Engineering 82-83 (2012) 44-49, 6 pgs.
(Continued)

*Primary Examiner* — Randy Boyer
*Assistant Examiner* — Juan C Valencia
(74) *Attorney, Agent, or Firm* — Dinsmore & Shohl, LLP

(57) ABSTRACT

A system for upgrading heavy hydrocarbon feeds, such as crude oil, include a hydrotreating unit, a hydrotreated effluent separation system, a solvent-assisted adsorption system, and a hydrocracking unit. Processes for upgrading heavy hydrocarbon feeds include hydrotreating the hydrocarbon feed to produce a hydrotreated effluent that includes asphaltenes, separating the hydrotreated effluent into a lesser boiling hydrotreated effluent and a greater boiling hydrotreated effluent comprising the asphaltenes, combining the greater boiling hydrotreated effluent with a light paraffin solvent to produce a combined stream, adsorbing the
(Continued)

asphaltenes from the combined stream to produce an adsorption effluent, and hydrocracking the lesser boiling hydrotreated effluent and at least a portion of the adsorption effluent to produce a hydrocracked effluent with hydrocarbons boiling less than 180° C. The systems and processes increase the hydrocarbon conversion and yield of hydrocarbons boiling less than 180° C.

20 Claims, 2 Drawing Sheets

(51) Int. Cl.
*C10G 45/00* (2006.01)
*C10G 25/00* (2006.01)
*C10G 25/12* (2006.01)

(52) U.S. Cl.
CPC ..... *C10G 47/00* (2013.01); *C10G 2300/107* (2013.01); *C10G 2300/206* (2013.01); *C10G 2300/301* (2013.01); *C10G 2300/4025* (2013.01); *C10G 2300/44* (2013.01); *C10G 2300/708* (2013.01); *C10G 2400/18* (2013.01); *C10G 2400/20* (2013.01)

(58) Field of Classification Search
CPC ..... C10G 2300/107; C10G 2300/206; C10G 2300/301; C10G 2300/4025; C10G 2300/44; C10G 2300/708; C10G 2400/18; C10G 2400/20
See application file for complete search history.

(56) References Cited

U.S. PATENT DOCUMENTS

| | | | | |
|---|---|---|---|---|
| 9,255,230 | B2 | 2/2016 | Shafi et al. | |
| 11,130,920 | B1 | 9/2021 | Koseoglu | |
| 2008/0093260 | A1 | 4/2008 | Koseoglu | |
| 2012/0132533 | A1 | 5/2012 | Yomagida et al. | |
| 2014/0221712 | A1 | 8/2014 | Greene et al. | |
| 2018/0044599 | A1* | 2/2018 | Zimmerman | C10G 67/06 |
| 2021/0189265 | A1 | 6/2021 | Ding et al. | |

FOREIGN PATENT DOCUMENTS

| | | | |
|---|---|---|---|
| FR | 3084371 | A1 | 1/2020 |
| WO | 2017019750 | A1 | 2/2017 |
| WO | 2021163352 | A1 | 8/2021 |

OTHER PUBLICATIONS

Balabin et al. "Petroleum resins adsorption onto quartz sand: Near infrared (NIR) spectroscopy study" Journal of Colloid and Interface Science 318 (2008) 167-174, 8 pgs.
Pernyeszi et al. "Asphaltene adsorption on clays and crude oil reservoir rocks" A: Physicochemical and Engineering Aspects 137 (1998) 373-384, 12 pgs.
Tarboush et al. "Dispersed Fe2O3 nanoparticles preparation in heavy oil and their uptake of asphaltenes" Fuel Processing Technology 133 (2015) 120-127, 8 pgs.
Notification of Transmittal of the International Search Report and the Written Opinion of the International Searching Authority, or the Declaration dated Apr. 18, 2023 pertaining to the International application No. PCT/US2022/053919 filed Dec. 23, 2022, pp. 1-15.

* cited by examiner

SYSTEMS AND PROCESSES FOR UPGRADING CRUDE OIL THROUGH HYDROCRACKING AND SOLVENT ASSISTED ON-LINE SOLID ADSORPTION OF ASPHALTENES

BACKGROUND

Field

The present disclosure relates to systems and processes for upgrading petroleum-based materials, in particular, systems and processes for upgrading and converting crude oil to greater value chemical products and intermediates through hydrocracking.

Technical Background

Petrochemical feeds, such as crude oils, can be converted to greater value chemical products and intermediates such as but not limited to clean transportation fuels, light olefins, and aromatic compounds, which are basic intermediates for a large portion of the petrochemical industry. The worldwide increasing demand for light olefins and aromatic compounds remains a major challenge for many integrated refineries. In particular, the production of some valuable light olefins such as ethylene, propene, and butene has attracted increased attention as pure olefin streams are considered the building blocks for polymer synthesis. Additionally, aromatic compounds such as benzene, toluene, ethylbenzene, and xylenes are valuable intermediates for synthesizing polymers and other organic compounds as well as for fuel additives.

SUMMARY

Crude oils and other heavy oils can be upgraded through hydroprocessing directly to greater value chemical products and intermediates, such as transportation fuels, olefins, and other hydrocarbons boiling at temperatures less than 180° C. During hydroprocessing, a hydrocarbon feed is reacted with hydrogen in the presence of one or more hydroprocessing catalysts to produce an upgraded effluent. One major technical challenge posed when hydroprocessing heavy oils, such as crude oil, desalted crude oil, or other heavy oil, is the effect of small concentrations of contaminants, such as, but not limited to metal containing compounds (organic nickel, vanadium compounds, or other metals), polynuclear aromatic compounds, and other coke precursors. These organometallic compounds and others have been proven to reduce the activity or useful life of hydroprocessing catalysts. The presence of such metal contaminants and polynuclear aromatic compounds can result in reduced process performance, increased capital costs, increased operating costs of refinery processing units, or combinations of these effects. The metals in the residual fraction of the crude oil deposits on the hydroprocessing catalyst and results in catalyst deactivation. The polynuclear aromatic compounds and some other compounds are coke precursors, and at high temperatures, they form coke, which also causes catalyst deactivation.

Heavy hydrocarbon feedstocks, such as crude oil, desalted crude oil, or other heavy oils, can also include core materials, such as asphaltenes, dispersed in lower polarity hydrocarbons. Intermediate polarity materials, usually referred to as resins, can associate with the polar core materials to maintain a homogeneous mixture of the components. Asphaltenes are organic heterocyclic macromolecules, which occur in crude oils, and are unsoluble in straight chain normal paraffin solvents, such as propane, n-pentane, n-heptane, and the like. Under normal reservoir conditions, asphaltenes are stabilized in the crude oil by maltenes and resins that are chemically compatible with the asphaltene compounds but that have a lesser molecular weight. Polar portions of the maltenes and resins surround the asphaltene compounds while non-polar portion of the maltenes and resins are attracted to the oil phase. However, changes in pressure, temperature, or composition of the heavy oil can alter the stability of the dispersion and increase the tendency of the asphaltene compounds to agglomerate into larger particles. As these asphaltene agglomerates grow, so does their tendency to precipitate out of the hydrocarbon solution.

One of the problems encountered during hydroprocessing of heavy oils, such as but not limited to crude oil, desalted crude oil, or other heavy oils, is sediment formation. The formation of sediments is related to the asphaltenes content in the heavy oil. Hydroprocessing can include hydrotreating followed by hydrocracking. Hydrotreating generally removes nitrogen, sulfur, and heavy metals from the heavy oil and can dearomatize some of the aromatic compounds in the heavy oil. During hydrotreating of heavy oils, the severe conditions in the hydrotreating unit can breakdown the oil fractions and resins that stabilize and solubilize the asphaltenes and other coke precursors. Destruction of the stabilization system for the asphaltenes and other coke precursors can lead to precipitation of asphaltene compounds and other coke precursors in the hydrotreated effluent, as previously discussed. The precipitated asphaltene compounds and other coke precursors can then deposit on hydrocracking catalysts in the downstream hydrocracking unit, causing deactivation of the hydrocracking catalysts. Deactivation of the hydrocracking catalysts caused by deposition of asphaltenes and coke on the hydrocracking catalyst can reduce the yield of greater value petrochemical products and intermediates from the process and can cause problems with catalyst life and smooth operation of the hydroprocessing unit. Even at small concentrations, such as less than 0.5 weight percent, asphaltene compounds and other coke precursors can cause significant deactivation of hydroprocessing catalysts, such as hydrocracking catalysts. Further, sediment formed during hydroprocessing operations may settle and deposit in such apparatuses as the catalytic reactor, distillation units, heat exchangers in the fractionation section, storage tanks, piping, or combinations of these. This affects the overall economy of the system since the reactor system cannot reach higher conversions.

When using crude oil, desalted oil, or other heavy oils as a hydrocarbon feeds for hydrocracking, up to 30 weight percent (wt. %) of the hydrocarbon feed can comprise constituents having boiling point temperatures greater than 540 degrees Celsius (° C.). These constituents boiling above 540° C. include the asphaltenes, polynuclear aromatic compounds, other coke precursors, and combinations of these, which can cause coke formation, catalyst deactivation, or both in the hydrocracking reactor. Thus, the constituents boiling above 540° C. are often rejected and removed from the system to reduce coke formation and catalyst deactivation and to ensure smooth operation of the hydrocracking unit. This results in up to a 30 percent reduction by weight of the hydrocarbons from the crude oil or heavy oil feedstock that can ultimately be converted to greater value petrochemical products and intermediates. Adsorption columns can be used to remove asphaltenes and polynuclear aromatic compounds from the system. However, adsorption columns can result in undesired adsorption of convertible hydrocarbons that can be easily converted to greater value constituents in the hydrocracking unit, thus, reducing the overall yield from the process.

Accordingly, there is an ongoing need for systems and processes for increasing the yield of greater value petrochemical products and intermediates from hydroprocessing when using crude oil, desalted oils, or other heavy oils for the hydrocarbon feed. The systems and processes of the present disclosure include a solvent-assisted adsorption system for removing asphaltene compounds from the system upstream of the hydrocracking unit. The solvent-assisted adsorption system removes asphaltenes while reducing the amount of usable hydrocarbons inadvertently adsorbed and removed from the system by the adsorbents. In particular, the systems and processes of the present disclosure include hydrotreating the hydrocarbon feed in a hydrotreating unit to produce a hydrotreated effluent, separating the hydrotreated effluent to produce a lesser boiling hydrotreated effluent and a greater boiling hydrotreated effluent, removing asphaltene compounds from the greater boiling hydrotreated effluent through the solvent-assisted adsorption system to produce an adsorption effluent, and then hydrocracking the lesser boiling hydrotreated effluent and at least a portion of the adsorption effluent in a hydrocracking unit. The use of solvent-assisted adsorption can increase the yield of greater value petrochemical products and intermediate, such as hydrocarbons having boiling point temperatures less than 180° C., from the process compared to other methods of reducing asphaltene compounds.

According to at least one aspect of the present disclosure, a process for upgrading a hydrocarbon feed can include hydrotreating the hydrocarbon feed to produce a hydrotreated effluent. The hydrotreated effluent can comprise asphaltenes, coke precursors, or both. The process further can comprise separating the hydrotreated effluent into a lesser boiling hydrotreated effluent and a greater boiling hydrotreated effluent, where the greater boiling hydrotreated effluent can comprise the asphaltenes, coke precursors, or both. The process further can comprise combining the greater boiling hydrotreated effluent with a light paraffin solvent to produce a combined stream, where the light paraffin solvent can reduce solubility of the asphaltenes in the combined stream, reduce the viscosity of the combined stream, or both. The process further can include adsorbing at least a portion of the asphaltenes, coke precursors, or both from the combined stream to produce an adsorption effluent and hydrocracking the lesser boiling hydrotreated effluent and at least a portion of the adsorption effluent to produce a hydrocracked effluent comprising a greater concentration of hydrocarbons having boiling point temperatures less than 180° C. compared to the hydrotreated effluent.

According to one or more other aspects of the present disclosure, a system for upgrading hydrocarbons can comprise a hydrotreating unit comprising at least one hydrotreating catalyst, where the hydrotreating unit can be configured to contact a hydrocarbon feed with hydrogen in the presence of the at least one hydrotreating catalyst. The contacting can upgrade the hydrocarbon feed to produce a hydrotreated effluent that can have a reduced concentration of at least one of nitrogen, sulfur, metals, or combinations of these. The system further can comprise a hydrotreated effluent separator that can separate the hydrotreated effluent into a lesser boiling hydrotreated effluent and a greater boiling hydrotreated effluent, a light paraffin solvent stream in fluid communication with the greater boiling hydrotreated effluent, and an adsorption unit downstream of the hydrotreating unit. The adsorption unit can be configured to contact a combined stream comprising a mixture of the greater boiling hydrotreated effluent and the light paraffin solvent stream with an adsorbent capable of adsorbing asphaltenes, coke precursors, or both from the combined stream. The system further can comprise a hydrocracking unit disposed downstream of the hydrotreating unit and the adsorption unit. The hydrocracking unit can comprise at least one hydrocracking catalyst, and the hydrocracking unit can be configured to contact a hydrocracker feed with hydrogen in the presence of the hydrocracking catalyst at conditions sufficient to convert at least a portion of the hydrocracker feed to produce a hydrocracked effluent comprising hydrocarbons having a boiling point temperature less than or equal to 180° C. The hydrocracker feed can comprise the lesser boiling hydrotreated effluent and at least a portion of an adsorption effluent from the adsorption unit.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
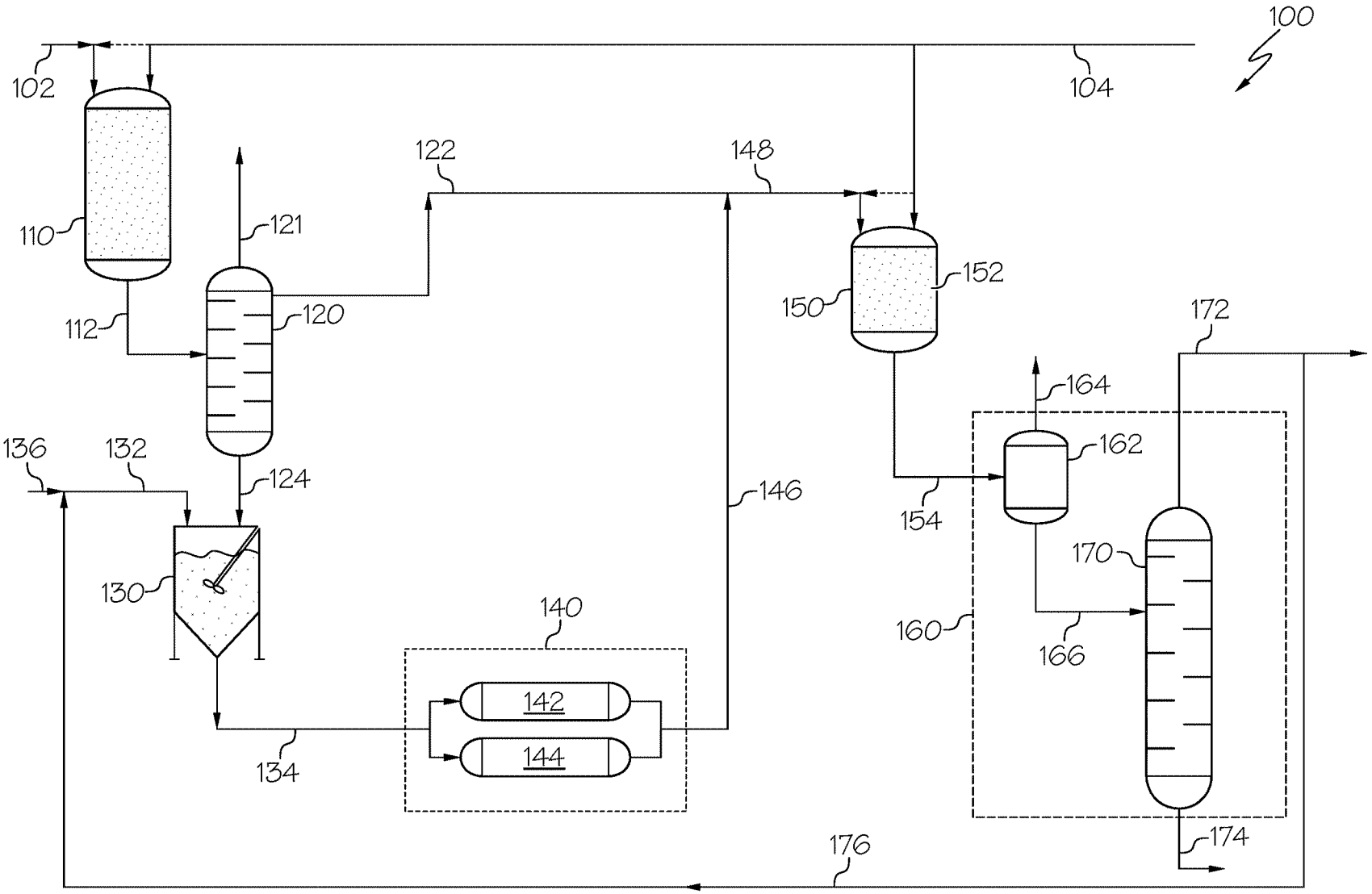
FIG. 1 schematically depicts a generalized flow diagram of a system for upgrading heavy oils to olefins, aromatic compounds, or both, according to one or more embodiments shown and described in this disclosure.
Figure 2:
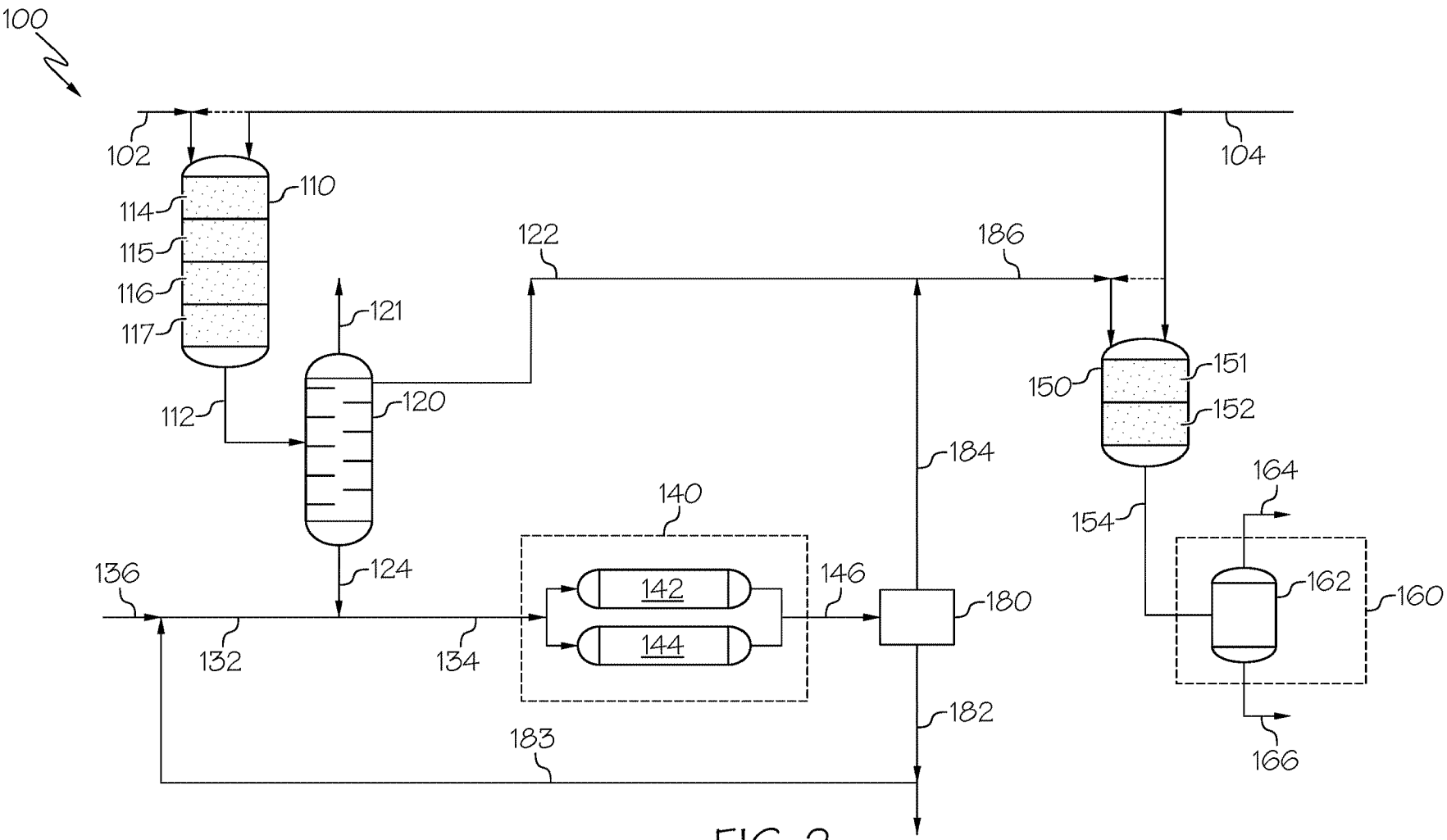
FIG. 2 schematically depicts a generalized flow diagram of another system for upgrading heavy oils to olefins, aromatic compounds, or both, according to one or more embodiments shown and described in this disclosure.

For the purpose of describing the simplified schematic illustrations and descriptions of FIGS. 1 and 2, the numerous valves, temperature sensors, electronic controllers and the like that may be employed and well known to those of ordinary skill in the art of certain chemical processing operations are not included. Further, accompanying components that are often included in chemical processing operations, such as, for example, air supplies, heat exchangers, surge tanks, or other related systems are not depicted. It would be known that these components are within the spirit and scope of the present embodiments disclosed. However, operational components, such as those described in the present disclosure, can be added to the embodiments described in this disclosure.

It should further be noted that arrows in the drawings refer to process streams. However, the arrows may equivalently refer to transfer lines that can serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows that do not connect two or more system components signify a product stream that exits the depicted system or a system inlet stream that enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1 and 2. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the separation unit of reactor, unless otherwise stated.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

The present disclosure is directed to systems and methods for upgrading heavy oils, such as crude oil, to produce more valuable petrochemical products and intermediates, such as but not limited to transportation fuels, light olefins, and other compounds. Referring to FIG. 1, one embodiment of a system 100 for upgrading a hydrocarbon feed 102 comprising crude oil or other heavy oil is schematically depicted. The system 100 includes a hydrotreating unit 110, hydrotreated effluent separator 120 disposed downstream of the hydrotreating unit 110, an adsorption unit 140 disposed downstream of the hydrotreated effluent separator 120, and a hydrocracking unit 150 disposed downstream of the adsorption unit 140. The system 100 can also include a hydrocracked effluent separation system disposed downstream of the hydrocracking unit 150. The process can include hydrotreating a hydrocarbon feed 102 in the hydrotreating unit 110 to upgrade the hydrocarbon feed 102 to produce a hydrotreated effluent 112 having reduced concentration of nitrogen, sulfur, metals, aromatic compounds, or combinations of these. The hydrotreated effluent 112 can further include asphaltenes, coke precursors, or both. The processes can include separating the hydrotreated effluent 112 into a lesser boiling hydrotreated effluent 122 and a greater boiling hydrotreated effluent 124 in the hydrotreated effluent separator 120, where the greater boiling hydrotreated effluent 124 comprises the asphaltenes, coke precursors, or both. The processes further include combining the greater boiling hydrotreated effluent 124 with a light paraffin solvent 132 to produce a combined stream 134, where the light paraffin solvent 132 reduces solubility of the asphaltenes in the combined stream 134 and reduces the viscosity of the combined stream 134. The processes further include adsorbing at least a portion of the asphaltenes, coke precursors, or both from the combined stream 134 in the adsorption unit 140 to produce an adsorption effluent 146 and hydrocracking at least a portion of the adsorption effluent 146 and the lesser boiling hydrotreated effluent 122 in the hydrocracking unit 150 to produce a hydrocracked effluent 154 comprising a greater concentration of hydrocarbons having boiling point temperatures less than 180° C. compared to the hydrotreated effluent 112.

The systems and process of the present disclosure can reduce the deactivation rate of hydrocracking catalysts by removing the asphaltenes and other coke precursors from the hydrotreated effluent 112 upstream of the hydrocracking unit 150. The systems and methods of the present disclosure can also increase proportion of the hydrocarbon feed subjected to hydrocracking by treating the fraction of the hydrocarbon boiling above 540° C. to remove the asphaltenes and passing the remaining hydrocarbons on to the hydrocracker instead of rejecting the 540° C.+ fraction. The systems and methods of the present disclosure also increase the proportion of the hydrocarbon feed subjected to hydrocracking by utilizing a solvent-assisted adsorption process, which reduces the amount of hydrocarbons inadvertently adsorbed onto adsorbents during the adsorption process. Reducing the rate of hydrocracking catalyst deactivation and increasing the proportion of hydrocarbons passed to the hydrocracking unit 150 can increase the conversion of hydrocarbons from the hydrocarbon feed and can increase yield of greater value petrochemical products and intermediates compared to existing hydrocracking systems.

As used in this disclosure, a "reactor" refers to any vessel, container, or the like, in which one or more chemical reactions may occur between one or more reactants optionally in the presence of one or more catalysts. For example, a reactor can include a tank or tubular reactor configured to operate as a batch reactor, a continuous stirred-tank reactor (CSTR), or a plug flow reactor. Example reactors include but are not limited to packed bed reactors such as fixed bed reactors, ebbulated bed reactors, slurry reactors, and fluidized bed reactors. One or more "reaction zones" may be disposed within a reactor. As used in this disclosure, a "reaction zone" refers to an area where a particular reaction takes place in a reactor. For example, a packed bed reactor with multiple catalyst beds can have multiple reaction zones, where each reaction zone is defined by the area of each catalyst bed.

As used in this disclosure, a "separation unit" or "separator" refers to any separation device or collection of separation devices that at least partially separates one or more chemicals in a mixture from one another. For example, a separation unit can selectively separate different chemical species from one another, forming one or more chemical fractions. Examples of separation units include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, and the like. It should be understood that separation processes described in this disclosure may not completely separate all of one chemical consistent from all of another chemical constituent. It should be understood that the separation processes described in this disclosure "at least partially" separate different chemical components from one another, and that even if not explicitly stated, it should be understood that separation can include only partial separation. As used in this disclosure, one or more chemical constituents can be "separated" from a process stream to form a new process stream. Generally, a process stream can enter a separation unit and be divided or separated into two or more process streams of desired composition.

As used in this disclosure, the term "fractionation" refers to a process of separating one or more constituents of a composition in which the constituents are divided from each other during a phase change based on differences in properties of each of the constituents. As an example, as used in this disclosure, "distillation" refers to separation of constituents of a liquid composition based on differences in the boiling point temperatures of constituents of a composition.

Further, in some separation processes, a "lesser-boiling effluent" and a "greater-boiling effluent" may separately exit the separation unit. In general, the lesser-boiling effluent has a lesser boiling point temperature than the greater-boiling effluent. Some separation systems can produce one or more "middle-boiling effluents," which can include constituents having boiling point temperatures between the boiling point temperatures of the lesser-boiling effluent and the greater-boiling effluent. The middle-boiling effluent may be referred to as a middle distillate. Some separation systems can be operable to produce a plurality of streams, each with a different boiling point range. It should be additionally understood that where only one separation unit is depicted in a figure or described, two or more separation units can be employed to carry out the identical or substantially identical separations. For example, where a distillation column with multiple outlets is described, it is contemplated that several separators arranged in series can equally separate the feed stream and such embodiments are within the scope of the presently described embodiments.

As used throughout this disclosure, the term "boiling point temperature" or "boiling temperature" refers to boiling point temperature at atmospheric pressure, unless otherwise stated.

As used throughout this disclosure, the term "cut point temperature" refers to a temperature that defines a boundary between two hydrocarbon fractions that are being separated through differences in boiling point temperatures.

As used in this disclosure, the term "end boiling point" or "EBP" of a composition refers to the temperature at which the greatest boiling temperature constituents of the composition transition from the liquid phase to the vapor phase.

As used in this disclosure, the terms "upstream" and "downstream" refer to the relative positioning of unit operations with respect to the direction of flow of the process streams. A first unit operation of a system is considered "upstream" of a second unit operation if process streams flowing through the system encounter the first unit operation before encountering the second unit operation. Likewise, the second unit operation is considered "downstream" of the first unit operation if the process streams flowing through the system encounter the first unit operation before encountering the second unit operation.

As used in the present disclosure, passing a stream or effluent from one unit "directly" to another unit refers to passing the stream or effluent from the first unit to the second unit without passing the stream or effluent through an intervening reaction system or separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined.

As used throughout the present disclosure, the term "butene" or "butenes" refer to one or more than one of 1-butene, trans-2-butene, cis-2-butene, isobutene, or mixtures of these isomers. As used throughout the present disclosure, the term "normal butenes" refers to one or more than one of 1-butene, trans-2-butene, cis-2-butene, or mixtures of these isomers, and does not include isobutene. As used throughout the present disclosure, the term "2-butene" refers to trans-2-butene, cis-2-butene, or a mixture of these two isomers.

As used throughout the present disclosure, the term "xylenes," when used without a designation of the isomer, such as the prefix para, meta, or ortho (or letters p, m, and o, respectively), refers to one or more of meta-xylene, ortho-xylene, para-xylene, and mixtures of these xylene isomers.

As used throughout the present disclosure, the term "crude oil" or "whole crude oil" refers to crude oil received directly from an oil field or from a desalting unit without having any fraction separated by distillation.

As used throughout the present disclosure, the term "light paraffin solvent" refers to a paraffinic solvent having from 3 to 7 carbon atoms and in which asphaltene compounds are insoluble.

As used throughout the present disclosure, the term "asphaltenes" refers to the component of a heavy oil fraction that is precipitated by addition of a low-boiling paraffin solvent, or paraffin naphtha, such as normal pentane, to the heavy oil fraction and is soluble in carbon disulfide and benzene. Asphaltenes are insoluble components or fractions and their concentrations are defined as the amount of asphaltenes precipitated by addition of an n-paraffin solvent to the heavy oil as prescribed in the Institute of Petroleum Method IP-143. The chemical structure of asphaltenes are complex and can include polynuclear aromatic hydrocarbons joined by alkyl chains and have molecular weights up to 20,000 Daltons. Asphaltenes can include nitrogen, sulfur and oxygen.

As used in this disclosure, the term "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" can more particularly be used to refer to a stream that is passed out of a reactor or reaction zone.

As used in this disclosure, a "catalyst" refers to any substance that increases the rate of a specific chemical reaction. Catalysts described in this disclosure can be utilized to promote various reactions, such as, but not limited to, hydrodemetalization, hydrodesulfurization, hydrodenitrogenation, hydrodearomatization, hydrocracking, cracking, aromatic cracking, or combinations thereof.

As used in this disclosure, "cracking" generally refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality. As used throughout the present disclosure, "hydrocracking" refers to catalytic cracking of hydrocarbons conducted in the presence of hydrogen.

It should be understood that the reactions promoted by catalysts as described in this disclosure can remove a chemical constituent, such as only a portion of a chemical constituent, from a process stream. For example, a hydrodemetalization (HDM) catalyst may be present in an amount sufficient to promote a reaction that removes a portion of one or more metals from a process stream. A hydrodenitrogenation (HDN) catalyst may be present in an amount sufficient to promote a reaction that removes a portion of the nitrogen present in a process stream. A hydrodesulfurization catalyst (HDS) catalyst may be present in an amount sufficient to promote a reaction that removes a portion of the sulfur present in a process stream. A hydrodearomatization catalyst (HDA) catalyst may be present in an amount sufficient to promote a reaction that converts aromatics to naphthalenes, paraffinic compounds, or both. A hydrocracking catalyst may be present in an amount sufficient to promote a reaction that converts aromatics to naphthalenes, paraffinic compounds, or both, which can be easier to convert in downstream processing units. It should be understood that, throughout this disclosure, a particular catalyst may not be limited in functionality to the removal, conversion, or cracking of a particular chemical constituent or moiety when it is referred to as having a particular functionality. For example, a catalyst identified in this disclosure as an HDN catalyst may additionally provide some degree of hydrodearomatization functionality, hydrodesulfurization functionality, or both.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring again to FIG. 1, one embodiment of a system 100 of the present disclosure for converting a hydrocarbon feed 102 to greater value petrochemical products or intermediates through hydrotreating and hydrocracking is schematically depicted. The greater value petrochemical products and intermediates can include but are not limited to transportation fuels, olefins, aromatic compounds, hydrocarbons having boiling point temperatures less than or equal to 180° C., or combinations of these. The system 100 includes the hydrotreating unit 110, the hydrotreated effluent separator 120 disposed downstream of the hydrotreating unit 110, the adsorption unit 140 disposed downstream of the hydrotreated effluent separator 120, and the hydrocracking unit 150 disposed downstream of the adsorption unit 140. The system 100 can further include a hydrocracked effluent separation system 160 disposed downstream of the hydrocracking unit 150. The hydrocracked effluent separation system 160 can include a first separator 162, a second separator 170, or both. In embodiments, the system 100 can include a solvent mixing vessel 130 disposed between the hydrotreated effluent separator 120 and the adsorption unit 140. Referring now to FIG. 2, in embodiments, the system 100 can further include an adsorption effluent separator 180.

Referring again to FIG. 1, the hydrocarbon feed 102 can include one or more heavy oils, such as but not limited to crude oil, topped crude oil, vacuum residue, tar sands, bitumen, atmospheric residue, vacuum gas oils, other heavy oil streams, or combinations of these. It should be understood that, as used in this disclosure, a "heavy oil" refers to a raw hydrocarbon, such as crude oil, which has not been previously processed through distillation, a hydrocarbon that has undergone some degree of processing prior to being introduced to the system 100 as the hydrocarbon feed 102, or a combination of both. The hydrocarbon feed 102 can have a density of less than or equal to 0.86 grams per milliliter. The hydrocarbon feed 102 can have an end boiling point (EBP) of greater than or equal to 720° C. The hydrocarbon feed 102 can have a concentration of nitrogen of less than or equal to 900 parts per million by weight (ppmw).

In embodiments, the hydrocarbon feed 102 is crude oil. The crude oil can have an American Petroleum Institute (API) gravity of from 15 degrees to 50 degrees, such as from 20 degrees to 50 degrees, from 20 degrees to 40 degrees, from 20 degrees to 35 degrees, from 25 degrees to 50 degrees, from 25 degrees to 40 degrees, from 25 degrees to 35 degrees, from 30 degrees to 50 degrees, or from 30 degrees to 40 degrees. For example, the hydrocarbon feed 102 can include an Arab light crude oil. Properties for an exemplary grade of Arab light crude oil are provided in Table 1.

TABLE 1

Example of Arab Light Export Feedstock

| Analysis | Units | Value | Test Method |
|---|---|---|---|
| American Petroleum Institute (API) gravity | degree | 33.13 | ASTM D287 |
| Density | grams per milliliter (g/mL) | 0.8595 | ASTM D287 |
| Carbon Content | weight percent (wt. %) | 85.29 | ASTM D5291 |
| Hydrogen Content | wt. % | 12.68 | ASTM D5292 |
| Sulfur Content | wt. % | 1.94 | ASTM D5453 |
| Nitrogen Content | parts per million by weight (ppmw) | 849 | ASTM D4629 |
| Asphaltenes | wt. % | 1.2 | ASTM D6560 |
| Micro Carbon Residue (MCR) | wt. % | 3.4 | ASTM D4530 |
| Vanadium (V) Content | ppmw | 15 | IP 501 |
| Nickel (Ni) Content | ppmw | 12 | IP 501 |
| Arsenic (As) Content | ppmw | 0.04 | IP 501 |
| Boiling Point Distribution | | | |
| Initial Boiling Point (IBP) | Degrees Celsius (° C.) | 33 | ASTM D7169 |
| 5% Boiling Point (BP) | ° C. | 92 | ASTM D7169 |
| 10% BP | ° C. | 133 | ASTM D7169 |
| 20% BP | ° C. | 192 | ASTM D7169 |
| 30% BP | ° C. | 251 | ASTM D7169 |

TABLE 1-continued

| Example of Arab Light Export Feedstock | | | |
|---|---|---|---|
| Analysis | Units | Value | Test Method |
| 40% BP | ° C. | 310 | ASTM D7169 |
| 50% BP | ° C. | 369 | ASTM D7169 |
| 60% BP | ° C. | 432 | ASTM D7169 |
| 70% BP | ° C. | 503 | ASTM D7169 |
| 80% BP | ° C. | 592 | ASTM D7169 |
| 90% BP | ° C. | >720 | ASTM D7169 |
| 95% BP | ° C. | >720 | ASTM D7169 |
| End Boiling Point (EBP) | ° C. | >720 | ASTM D7169 |
| BP range C5-180° C. | wt. % | 18.0 | ASTM D7169 |
| BP range 180° C.-350° C. | wt. % | 28.8 | ASTM D7169 |
| BP range 350° C.-540° C. | wt. % | 27.4 | ASTM D7169 |
| BP range >540° C. | wt. % | 25.8 | ASTM D7169 |

Weight percentages in Table 1 are based on the total weight of the crude oil.

When the hydrocarbon feed 102 comprises, consists of, or consists essentially of a crude oil, where the crude oil can be a whole crude or a crude oil that has undergone at least some processing, such as desalting, solids separation, scrubbing, or combinations of these, but has not been subjected to distillation. For example, the hydrocarbon feed 102 can be a de-salted crude oil that has been subjected to a de-salting process. In embodiments, the hydrocarbon feed 102 can include a crude oil that has not undergone pretreatment, separation (such as distillation), or other operation that changes the hydrocarbon composition of the crude oil prior to introducing the crude oil to the system 100. In embodiments, the hydrocarbon feed 102 can be a topped crude oil. As used in the present disclosure, the term "topped crude oil" refers to crude oil from which lesser boiling constituents have been removed through distillation, such as constituents having boiling point temperatures less than 180° C. or even less than 160° C. In embodiments, the hydrocarbon feed 102 comprises, consists or, or consists essentially of a topped crude oil, which has greater than or equal to 95%, greater than or equal to 98%, or even greater than or equal to 99% constituents having boiling point temperatures greater than or equal to 160° C. or greater than or equal to 180° C., depending on the cut point temperature of the topping unit.

Referring again to FIG. 1, the hydrocarbon feed 102 can be introduced directly to the hydrotreating unit 110 or can be combined with hydrogen 104 upstream of the hydrotreating unit 110. The hydrogen 104 can be recycled hydrogen recovered from the system 100, such as excess hydrogen recovered from the hydrotreated effluent separator 120, excess hydrogen recovered from hydrocracked effluent separation system 160, or both. The hydrogen 104 may also include supplemental hydrogen from an external hydrogen source (not shown). The hydrogen 104 can be passed directly to the hydrotreating unit 110 or combined with the hydrocarbon feed 102 upstream of the hydrotreating unit 110.

The hydrotreating unit 110 is operable to remove one or a plurality of impurities, such as metals, sulfur compounds, nitrogen compounds, or combinations of these, from the hydrocarbon feed 102. Additionally, the hydrotreating unit 110 can be operable to saturate at least a portion of aromatic or polyaromatic compounds in the hydrocarbon feed 102. The hydrotreating unit 110 includes at least one hydrotreating catalyst, which can be disposed in at least one hydrotreating zone within the hydrotreating unit 110. The hydrotreating unit 110 is operable to contact the hydrocarbon feed 102 with the hydrogen 104 in the presence of the hydrotreating catalyst, where the contacting upgrades the hydrocarbon feed 102 to produce a hydrotreated effluent 112 having a reduced concentration of at least one of nitrogen, sulfur, metals, aromatic compounds, or combinations of these.

The hydrotreating unit 110 can include one or a plurality of hydrotreating zones. Referring now to FIG. 2, the hydrotreating unit 110 can include a plurality of packed bed reaction zones arranged in series, such as one or more of a hydrodemetalization (HDM) zone 114, a transition zone 115, a hydrodesulfurization (HDS) zone 116, a hydrodenitrogenation (HDN) zone 117, a hydrodearomatization (HDA) zone (not shown), or combinations of these reaction zones. Each of the plurality of reaction zones can be disposed in a single reactor or in multiple reactors in series. Each of the HDM zone 114, the transition zone 115, the HDS zone 116, the HDN zone 117, and the HDA zone (not shown) can include a catalyst bed comprising a hydrotreating catalyst. The hydrotreating unit 110 can include one or a plurality of the HDM zone 114 comprising an HDM catalyst, the transition zone 115 comprising a transition catalyst, the HDS zone 116 comprising an HDS catalyst, the HDN zone 117 comprising an HDN catalyst, the HDA zone comprising an HDA catalyst, or combinations of these. The reaction zones of the hydrotreating unit 110 can be in any order, and are not necessarily in the order depicted in FIG. 2. Additionally, the hydrotreating unit 110 may have more or fewer reaction zones compared to the hydrotreating unit shown in FIG. 2. In embodiments, the hydrotreating unit 110 includes the HDM zone 114, the transition zone 115 downstream of the HDM zone 114, and the HDS zone 116 downstream of the transition zone 115. The hydrotreating unit 110 can include any type of reactor suitable for contacting the hydrocarbon feed 102 with the hydrogen 104 in the presence of the hydrotreating catalysts. Suitable reactors can include, but are not limited to, fixed bed reactors, ebbulated bed reactors, slurry bed reactors, moving bed reactors, fluidized bed reactors, plug flow reactors, other type of reactor, or combinations of reactors. In embodiments, the hydrotreating unit 110 comprises one or more fixed bed reactors, which may be operated in downflow, upflow, or horizontal flow configurations.

Referring to FIGS. 1 and 2, the hydrotreating catalysts in the hydrotreating unit 110 can include one or more metals selected from the metallic elements in Groups 5, 6, 8, 9, or 10 of the International Union of Pure and Applied Chemistry (IUPAC) periodic table, such as, but not limited to, molybdenum, nickel, cobalt, tungsten, or combinations of these. The metals of the hydrotreating catalysts can be present as pure metals, metal oxides, metal sulfides, or combinations of these. The metals, metal oxides, or metal sulfides of the hydrotreating catalysts can be supported on a support material, such as but not limited to silica, alumina, or a combination of these. The support material can include, but is not limited to, gamma-alumina or silica/alumina extrudates, spheres, cylinders, beads, pellets, and combinations thereof. In embodiments, the hydrotreating catalysts comprises nickel and molybdenum on an alumina support or cobalt and molybdenum on an alumina support.

When the hydrotreating catalysts present in the hydrotreating unit 110 include an HDM catalyst, the HDM catalyst can comprise one or more metals from the Groups 5, 6, or 8-10 of the IUPAC periodic table, which may be in the form of metals, metal oxides, metal sulfides, or combinations of these. In embodiments, the HDM catalyst comprises molybdenum. The HDM catalyst can further include a support material, and the metal can be disposed on the support material. In embodiments, the support material is a gamma-alumina support having a surface area of from 100 meters squared per gram ($m^2/g$) to 160 $m^2/g$, such as from 100 $m^2/g$ to 130 $m^2/g$, or from 130 $m^2/g$ to 160 $m^2/g$. In embodiments, the HDM catalyst comprises from 0.5 wt. % to 12 wt. % of an oxide or sulfide of molybdenum, such as from 2 wt. % to 10 wt. % or from 3 wt. % to 7 wt. % of an oxide or sulfide of molybdenum based on the total weight of the HDM catalyst. The HDM catalyst can have a total pore volume of greater than or equal to 0.8 cubic centimeters per gram ($cm^3/g$), greater than or equal to 0.9 $cm^3/g$, or even greater than or equal to 1.0 $cm^3/g$. The HDM catalyst can be macroporous having an average pore size of greater than or equal to 50 nanometers (nm). The HDM catalyst can include a dopant comprising one or more compounds that include elements selected from the group consisting of boron, silicon, halogens, phosphorus, and combinations thereof.

When the hydrotreating catalysts present in the hydrotreating unit 110 include an HDS catalyst, the HDS catalyst can include one or more metals supported on a support material. The metals of the HDS catalyst can comprise one or more metals from Group 6 and one metal from Groups 8-10 of the IUPAC periodic table, which can be present as metals, metal oxides, or metal sulfides. The HDS catalyst can include one or more metals selected from molybdenum, tungsten, nickel, cobalt, or combinations of these, each of which can be present as metals, metal oxides, or metal sulfides. The HDS catalyst can further include a support material, and the metals, metal oxides, or metal sulfides may be disposed on the support material. In embodiments, the HDS catalyst can comprise Mo and Ni on an alumina support (sometimes referred to as a "Mo—Ni/$Al_2O_3$ catalyst"). In embodiments, the HDS catalyst can contain a dopant that is selected from the group consisting of boron, phosphorus, halogens, silicon, and combinations thereof. The HDS catalyst can include from 10 wt. % to 18 wt. % of an oxide or sulfide of molybdenum, such as from 11 wt. % to 17 wt. % or from 12 wt. % to 16 wt. % of an oxide or sulfide of molybdenum based on the total weight of the HDS catalyst. Additionally or alternatively, the HDS catalyst can include from 1 wt. % to 7 wt. % of an oxide or sulfide of nickel, such as from 2 wt. % to 6 wt. % or from 3 wt. % to 5 wt. % of an oxide or sulfide of nickel based on the total weight of the HDS catalyst. The HDS catalyst can have an average surface area of 140 $m^2/g$ to 200 $m^2/g$, such as from 140 $m^2/g$ to 170 $m^2/g$ or from 170 $m^2/g$ to 200 $m^2/g$. The HDS catalyst can have a total pore volume of from 0.5 $cm^3/g$ to 0.7 $cm^3/g$, such as 0.6 $cm^3/g$. The HDS catalyst can generally have a mesoporous structure having pore sizes in the range of 2 nm to 50 nm, such as from 12 nm to 50 nm.

When the hydrotreating catalysts present in the hydrotreating unit 110 include an HDN catalyst, the HDN catalyst can include a metal oxide or sulfide supported on a support material. The metals of the HDN catalyst can comprise one or more metals from Groups 5, 6, and 8-10 of the IUPAC periodic table, which can be present as metals, metal oxides, or metal sulfides. In embodiments, the HDN catalyst contains at least one metal from IUPAC Group 6, such as but not limited to molybdenum, and at least one metal from IUPAC Groups 8-10, such as but not limited to nickel. The HDN catalyst can also include at least one dopant selected from the group consisting of boron, phosphorus, silicon, halogens, and combinations thereof. In embodiments, cobalt can be included to increase desulfurization of the HDN catalyst. The HDN catalyst can have a greater metals loading for the active phase compared to the HDM catalyst. This increased metals loading can result in increased catalytic activity. In embodiments, the HDN catalyst comprises nickel (Ni) and molybdenum (Mo), and has a nickel to molybdenum mole ratio (Ni/(Ni+Mo)) of 0.1 to 0.3 (such as from 0.1 to 0.2 or from 0.2 to 0.3). In embodiments, the HDN catalyst comprises cobalt (Co), nickel (Ni), and molebdenum (Mo) and has a mole ratio of (Co+Ni)/Mo in a range of from 0.25 to 0.85, such as from 0.25 to 0.5 or even from 0.5 to 0.85.

The support material can include gamma-alumina, mesoporous alumina, silica, or both, in the form of extrudates, spheres, cylinders and pellets. In embodiments, the HDN catalyst comprises a gamma alumina based support material that has a surface area of 180 $m^2/g$ to 240 $m^2/g$, such as from 180 $m^2/g$ to 210 $m^2/g$, or from 210 $m^2/g$ to 240 $m^2/g$. This relatively large surface area for the HDN catalyst corresponds to a smaller pore volume, such as pore volumes of less than 1.0 $cm^3/g$, less than or equal to 0.95 $cm^3/g$, or even less than or equal to 0.9 $cm^3/g$. The HDN catalyst can comprise from 10 wt. % to 18 wt. % of an oxide or sulfide of molybdenum, such as from 13 wt. % to 17 wt. % or from 14 wt. % to 16 wt. % of an oxide or sulfide of molybdenum, based on the total weight of the HDN catalyst. The HDN catalyst can comprise from 2 wt. % to 8 wt. % of an oxide or sulfide of nickel, such as from 3 wt. % to 7 wt. % or from 4 wt. % to 6 wt. % of an oxide or sulfide of nickel, based on the total weight of the HDN catalyst. The HDN catalyst can include from 74 wt. % to 88 wt. % of alumina, such as from 76 wt. % to 84 wt. % or from 78 wt. % to 82 wt. % of alumina, based on the total weight of the HDN catalyst.

When the hydrotreating unit 110 includes a transition reaction zone 115, the transition reaction zone 115 can be operable to remove a quantity of metal components and a quantity of sulfur components from the HDM reaction effluent stream. The transition catalyst can include an alumina-based support in the form of extrudates and at least one metal species supported on the alumina-based support. The metal species can be in the form of metals, metal oxides, or metal sulfides. The metal species of the transition catalyst can include at least one metal from Group 6 and at least one metal from Groups 8-10 of the IUPAC periodic table, which can be in the form of metals, metal oxides, metal sulfides, or combinations of these. Example metals from Group 6 of the IUPAC periodic table include molybdenum and tungsten. Example metals from IUPAC Group 8-10 include nickel and cobalt. In embodiments, the transition catalyst comprises Mo and Ni on an alumina support (sometimes referred to as "Mo—Ni/$Al_2O_3$ catalyst"). The transition catalyst can also contain a dopant that is selected from the group consisting of boron, phosphorus, halogens, silicon, and combinations thereof. The transition catalyst can have a surface area of 140 $m^2/g$ to 200 $m^2/g$, such as from 140 $m^2/g$ to 170 $m^2/g$ or from 170 $m^2/g$ to 200 $m^2/g$. The transition catalyst can have an intermediate pore volume of from 0.5 $cm^3/g$ to 0.7 $cm^3/g$, such as about 0.6 $cm^3/g$. The transition catalyst can generally comprise a mesoporous structure having pore sizes in the range of 12 nm to 50 nm. These characteristics of the transition catalyst provide a balanced activity in HDM and HDS. The transition catalyst can comprise from 10 wt. % to 18 wt. % of an oxide or sulfide of molybdenum (such as from 11 wt. % to 17 wt. % or from 12 wt. % to 16 wt. % of an oxide or sulfide of molybdenum), from 1 wt. % to 7 wt. % of an oxide or sulfide of nickel (such as from 2 wt. % to 6 wt. % or from 3 wt. % to 5 wt. % of an oxide or sulfide of nickel), and from 75 wt. % to 89 wt. % of alumina (such as from 77 wt. % to 87 wt. % or from 79 wt. % to 85 wt. % of alumina).

When the hydrotreating catalysts present in the hydrotreating unit 110 include an HDA catalyst, the HDA catalyst can comprise one or more metals from Groups 5, 6, 8, 9, or 10 of the IUPAC periodic table, which can be present as metals, metal oxides, or metal sulfides. The HDA catalyst can include one or more metals from Groups 5 or 6 of the IUPAC periodic table, and one or more metals from Groups 8, 9, or 10 of the IUPAC periodic table. The HDA catalyst can include one or a plurality of molybdenum, tungsten, nickel, cobalt, or combinations of these, which can be present as metals, metal oxides, metal sulfides, or combinations of these. The HDA catalyst can further comprise a support material, such as zeolite, and the metal may be disposed on the support material. In embodiments, the HDA catalyst can comprise tungsten and nickel metal catalyst on a zeolite support that is mesoporous (sometimes referred to as "W—Ni/meso-zeolite catalyst"). In embodiments, the HDA catalyst can comprise molybdenum and nickel metal catalyst on a zeolite support that is mesoporous (sometimes referred to as "Mo—Ni/meso-zeolite catalyst"). The zeolite support material may not be limited to any particular type of zeolite. However, it is contemplated that zeolites such as Y, Beta, AWLZ-15, LZ-45, Y-82, Y-84, LZ-210, LZ-25, Silicalite, or mordenite framework zeolites may be suitable for use in the presently-described HDA catalyst. The support material of the HDA catalyst can be mesoporous zeolite having an average pore size of from 2 nm to 50 nm.

The HDA catalyst can include from 18 wt. % to 28 wt. % of a sulfide or oxide of tungsten, such as from 20 wt. % to 27 wt. % or from 22 wt. % to 26 wt. % of tungsten or a sulfide or oxide of tungsten based on the total weight of the HDA catalyst. The HDA catalyst can additionally include, from 2 wt. % to 8 wt. % of an oxide or sulfide of nickel, such as from 3 wt. % to 7 wt. % or from 4 wt. % to 6 wt. % of an oxide or sulfide of nickel based on the total weight of the HDA catalyst. In embodiments, the HDA catalyst can comprise from 12 wt. % to 18 wt. % of an oxide or sulfide of molybdenum, such as from 13 wt. % to 17 wt. % or from 14 wt. % to 16 wt. % of an oxide or sulfide of molybdenum based on the total weight of the HDA catalyst, and from 2 wt. % to 8 wt. % of an oxide or sulfide of nickel, such as from 3 wt. % to 7 wt. % or from 4 wt. % to 6 wt. % of an oxide or sulfide of nickel based on the total weight of the HDA catalyst.

The hydrocarbon feed 102 is contacted with hydrogen 104 in the presence of the hydrotreating catalysts in the hydrotreating unit 110 at a hydrotreating temperature and hydrotreating pressure sufficient to upgrade the hydrocarbon feed 102 to remove one or a plurality of metals, nitrogen compounds, sulfur compounds, aromatic compounds, or combinations of these. The hydrotreating unit 110 can be operated at a hydrotreating temperature of from 300° C. to 450° C., such as from 350° C. to 420° C. The hydrotreating unit 110 can be operated at a hydrotreating pressure of from 50 bar (5,000 kilopascals (kPa)) to 200 bar (20,000 kPa), such as from 130 bar (13,000 kPa) to 160 bar (16,000 kPa). The hydroprocessing unit 110 can operate with a liquid hourly volume space velocity (LHSV) of from 0.1 per hour ($hr^{-1}$) to 1 $hr^{-1}$, such as from 0.2 $hr^{-1}$ to 0.7 $hr^{-1}$. The volume ratio of hydrogen 104 to the hydrocarbon feed 102 introduced to the hydrotreating unit 110 can be from 800:1 to 1200:1. The hydrogen 104 can be introduced to the hydrotreating unit 110 at the inlet of the hydrotreating unit 110. In some embodiments, hydrogen 104 can be introduced to each of the reaction zones, such as the HDM zone 114, the transition zone 115, the HDS zone 116, the HDN zone 117, the HDA reaction zone (not shown), or combinations of these.

Referring again to FIG. 1, the hydrotreated effluent 112 passed out of the hydrotreating unit 110 can have a concentration of one or more of metals, sulfur-containing hydrocarbons, nitrogen-containing hydrocarbons, aromatic compounds, or combinations of these that is less than a concentration of these compounds in the hydrocarbon feed 102 by at least 2 percent (%), at least 5%, at least 10%, at least 25%, at least 50%, or even at least 75%. As previously discussed, contact of the hydrocarbon feed 102 with hydrogen 104 in the presence of the hydrotreating catalysts, such as the transition catalyst, HDS catalyst, HDN catalyst, or combinations of these, in the hydrotreating unit 110 can cause reaction of sulfur-containing hydrocarbons, nitrogen-containing hydrocarbons, or both, in the hydrocarbon feed 102 to remove at least a portion of the sulfur and nitrogen from the hydrocarbons of the hydrocarbon feed 102. The sulfur-containing hydrocarbons can be converted to hydrocarbons and sulfur-containing gases, such as hydrogen sulfide ($H_2S$) for example, and the nitrogen-containing hydrocarbons can be converted to hydrocarbons and nitrogen-containing gases, such as ammonia ($NH_3$).

The sulfur-containing gases and nitrogen-containing gases can be removed from the system 100 downstream by the hydrotreated effluent separator 120, the hydrocracked effluent separation system 160, or both. The hydrotreated effluent 112 can have a concentration of sulfur-containing hydrocarbons less than a concentration of sulfur-containing hydrocarbons in the hydrocarbon feed 102. The hydrotreated effluent 112 can have a concentration of sulfur-containing hydrocarbons of less than or equal to 0.10 wt. %, such as from 0.001 wt. % to 0.10 wt. %, from 0.01 wt. % to 0.10 wt. %, from 0.01 wt. % to 0.08 wt. %, from 0.01 wt. % to 0.05 wt. %, from 0.02 wt. % to 0.10 wt. %, from 0.02 wt. % to 0.08 wt. %, or from 0.02 wt. % to 0.07 wt. % based on the total weight of the hydrotreated effluent 112. The hydrotreated effluent 112 can have a concentration of nitrogen-containing hydrocarbons less than a concentration of nitrogen-containing hydrocarbons in the hydrocarbon feed 102. The hydrotreated effluent 112 can have a concentration of nitrogen-containing hydrocarbons of from 0 parts per million by weight (ppmw) to 500 ppmw, such as from 10 ppmw to 500 ppmw, from 10 ppmw to 400 ppmw, from 10 ppmw to 300 ppmw, from 50 ppmw to 500 ppmw, from 50 ppmw to 400 ppmw, or from 50 ppmw to 300 ppmw based on the total weight of the hydrotreated effluent 112.

Contact of the hydrocarbon feed 102 with hydrogen 104 in the presence of the hydrotreating catalysts, such as the HDM catalyst, transition catalyst, or both, in the hydrotreating unit 110 may operate to remove metals from the hydrocarbon feed 102 so that the hydrotreated effluent 112 has a metals concentration that is less than the metals concentration of the hydrocarbon feed 102. The hydrotreated effluent 112 can have a metals concentration of from 0 ppmw to 100 ppmw, such as from 0 ppmw to 75 ppmw, from 0 ppmw to 50 ppmw, from 0 ppmw to 25 ppmw, from 0 ppmw to 10 ppmw, from 0 ppmw to 5 ppmw, from 0.1 ppmw to 100 ppmw, from 0.1 ppmw to 75 ppmw, from 0.1 ppmw to 50 ppmw, from 0.1 ppmw to 25 ppmw, from 0.1 ppmw to 10 ppmw, or from 0.1 ppmw to 5 ppmw metals based on the total weight of the hydrotreated effluent 112. The hydrotreated effluent 112 can have a nickel concentration that is less than a nickel concentration of the hydrocarbon feed 102, such as a nickel concentration of from 0 ppmw to 10 ppmw, from 0.1 ppmw to 10 ppmw, from 0.1 ppmw to 5 ppmw, or from 0.1 ppmw to 1 ppmw nickel based on the total weight of the hydrotreated effluent 112. The hydrotreated effluent 112 can have an arsenic content less than an arsenic content of the hydrocarbon feed 102, such as from 0 ppmw to 1 ppmw, from 0.01 ppmw to 1 ppmw, or from 0.01 ppmw to 0.5 ppmw arsenic based on the total weight of the hydrotreated effluent 112. The hydrotreated effluent 112 can have a vanadium content less than a vanadium content of the hydrocarbon feed 102, such as from 0 ppmw to 10 ppmw, such as from 0.1 ppmw to 10 ppmw, from 0.1 ppmw to 5 ppmw, or even from 0.1 ppmw to 1 ppmw vanadium based on the total weight of the hydrotreated effluent 112.

The hydrotreated effluent 112 can have a concentration of aromatic compounds less than the concentration of aromatic compounds in the hydrocarbon feed 102. The hydrotreated effluent 112 can have a concentration of aromatic compounds of from 5 wt. % to 40 wt. %, such as from 5 wt. % to 30 wt. %, or from 5 wt. % to 20 wt. % aromatic compounds based on the total weight of the hydrotreated effluent 112. The hydrotreated effluent 112 may have a concentration of asphaltenes, polyaromatics, and other coke precursors of from 0.01 wt. % to 5 wt. %, such as from 0.01 wt. % to 2 wt. %, from 0.01 wt. % to 0.75 wt. %, or from 0.01 wt. % to 0.50 wt. % based on the total weight of the hydrotreated effluent 112.

Still referring to FIG. 1, at least 20 wt. % of the hydrotreated effluent 112 can have a boiling point temperature of less than or equal to 225° C. In embodiments, at least 5 wt. %, at least 10 wt. %, at least 20 wt. %, or even at least 30 wt. % of the hydrotreated effluent 112 can have a boiling point temperature of less than or equal to 225° C. The hydrotreated effluent 112 can have an initial boiling point (IBP) temperature of less than or equal to 100° C., such as less than or equal to 90° C., less than or equal to 80° C., less than or equal to 70° C., or even less than or equal to 60° C. The hydrotreated effluent 112 can have a T5 temperature of less than or equal to 150° C., less than or equal to 130° C., less than or equal to 120° C., less than or equal to 110° C., or even less than or equal to 100° C., where the T5 temperature is the temperature below which 5% of the constituents boil. The hydrotreated effluent 112 can have a T95 temperature of greater than or equal to 570° C., greater than or equal to 580° C., greater than or equal to 590° C., greater than or equal to 600° C., or even greater than or equal to 610° C., where the T95 temperature is the temperature at which 95% of the constituents of the hydrotreated effluent 112 boil. In embodiments, the hydrotreated effluent 112 can have a concentration of constituents having boiling point temperatures greater than 540° C. of from 5 wt. % to 30 wt. %, such as from 5 wt. % to 20 wt. %, from 10 wt. % to 20 wt. %, or from 10 wt. % to 15 wt. % based on the total weight of the hydrotreated effluent 112.

The hydrotreated effluent 112 can have a density less than the density of the hydrocarbon feed 102. The hydrotreated effluent 112 can have a density of from 0.80 grams per milliliter (g/mL) to 0.95 g/mL, such as from 0.80 g/mL to 0.90 g/mL, from 0.80 g/mL to 0.85 g/mL, from 0.82 g/mL to 0.95 g/mL, from 0.82 g/mL to 0.90 g/mL, from 0.82 g/mL to 0.85 g/mL, from 0.83 g/mL to 0.95 g/mL, 0.83 g/mL to 0.90 g/mL, or from 0.83 g/mL to 0.85 g/mL. The hydrotreated effluent 112 can have an API gravity greater than the API gravity of the hydrocarbon feed 102 introduced to the hydrotreating unit 110. The hydrotreated effluent 112 can have an API gravity of less than or equal to 50 degrees, less than or equal to 40 degrees, or even less than or equal to 30 degrees. In embodiments, the hydrotreated effluent 112 can have an API from 25 degrees to 50 degrees, from 30 degrees to 50 degrees, from 25 degrees to 45 degrees, or from 25 degrees to 40 degrees.

The hydrotreated effluent 112 can be further hydrocracked in a hydrocracking unit 150 downstream of the hydrotreating unit 110 to convert at least a portion of the hydrocarbons from the hydrotreated effluent 112 to greater value chemical products and intermediates. However, hydrocracking catalysts may be at least partially deactivated by deposition of contaminants, such as coke or asphaltenes, on the surfaces of the hydrocracking catalyst. Hydrotreating the hydrocarbon feed 102 in the hydrotreating unit 110 deconstructs some of the aromatic compounds that stabilize the solution of asphaltenes and other coke precursors in the hydrocarbon feed 102. Upon deconstruction of the stabilizing aromatic compounds in the hydrotreated effluent 112, the asphaltenes and other coke precursors can precipitate out of the hydrotreated effluent 112. When the hydrotreated effluent 112 is passed directly to the hydrocracking unit 150 and contacted with the hydrocracking catalyst, the precipitated asphaltenes deposit on the surfaces of the hydrocracking catalysts. Coke precursors in the hydrotreated effluent 112 can also produce coke at the reaction conditions of the hydrocracking reaction, and the coke can also deposit on the surfaces of the hydrocracking catalyst. Thus, the presence of asphaltenes and other coke precursors in the hydrotreated effluent 112 have a detrimental effect on the service life of the hydrocracking catalyst in the hydrocracking unit 150. Even small amounts of asphaltenes and coke precursors, such as less than or equal to 0.5 wt. % in the hydrotreated effluent 112 can cause problems with hydrocracking catalyst deactivation and disrupt smooth steady-state operation of the system 100.

Referring again to FIG. 1, the system 100 and processes of the present disclosure include a solvent assisted adsorption system operable to remove asphaltenes, polyaromatic compounds, and other coke precursors and contaminants from the hydrotreated effluent 112 upstream of the hydrocracking unit 150. The solvent assisted adsorption system operates by separating the hydrotreated effluent 112 into a lesser boiling hydrotreated effluent 122 and a greater boiling hydrotreated effluent 124, which includes the asphaltenes and coke precursors. The greater boiling hydrotreated effluent 124 is then combined with a light paraffin solvent 132 that acts to decrease the solubility of the asphaltenes and coke precursors in the hydrocarbons and to reduce the viscosity of the greater boiling hydrotreated effluent 124. Decreasing the solubility of the asphaltenes and coke precursors can increase precipitation and agglomeration of the asphaltenes and coke precursors. The increased precipitation and agglomeration makes it easier to selectively adsorb the asphaltenes and coke precursors in an adsorption unit while reducing the adsorption of hydrocarbons that are capable of being converted to greater value petrochemical product and intermediates in the hydrocracking reactor. Selectively adsorbing the asphaltenes and coke precursors through solvent assisted adsorption can reduce deposition of contaminants and coke on the hydrocracking catalysts during hydrocracking, which can increase the yield from the hydrocracking process and increase the service life of the hydrocracking catalysts.

The solvent-assisted adsorption system includes at least the hydrotreated effluent separator 120 and an adsorption unit 140 downstream of the hydrotreated effluent separator 120. In embodiments, the solvent-assisted adsorption system may further include a solvent mixing vessel 130 disposed between the hydrotreated effluent separator 120 and the adsorption unit 140, where the solvent mixing vessel 130 is operable to combine a portion of the hydrotreated effluent 112, such as the greater boiling hydrotreated effluent 124, with a light paraffin solvent 132 upstream of the adsorption unit 140. Referring to FIG. 2, in other embodiments, the light paraffin solvent 132 may be combined directly with the greater boiling hydrotreated effluent 124 without using the solvent mixing vessel 130.

Referring again to FIG. 1, the hydrotreated effluent separator 120 is disposed directly downstream of the hydrotreating unit 110. The hydrotreated effluent separator 120 can be in fluid communication with the hydrotreating unit 110 to pass the hydrotreated effluent 112 directly from the hydrotreating unit 110 to the hydrotreated effluent separator 120. The hydrotreated effluent separator 120 operates to separate the hydrotreated effluent 112 into a lesser boiling hydrotreated effluent 122 and a greater boiling hydrotreated effluent 124. The hydrotreated effluent separator 120 may also produce a light gas stream 121. The hydrotreated effluent separator 120 can include one or a plurality of separation units in parallel or in series. In embodiments, the hydrotreated effluent separator 120 can include one or a plurality of distillation units. The hydrotreated effluent separator 120 can be operated at a cut point temperature in the range of from 450° C. to 550° C., such as from 490° C. to 540° C. In embodiments, the hydrotreated effluent separator 120 can be operated at a cut point temperature of about 540° C. In embodiments, the hydrotreated effluent separator 120 can be a fractionation unit that produces the light gas stream 121, the lesser boiling hydrotreated effluent 122, and the greater boiling hydrotreated effluent 124.

The lesser boiling hydrotreated effluent 122 can include at least 90%, at least 95%, at least 98%, or even at least 99% of the constituents of the hydrotreated effluent 112 having boiling point temperatures less than the cut point temperature of the hydrotreated effluent separator 120. The greater boiling hydrotreated effluent 124 can include at least 90%, at least 95%, at least 98%, or even at least 99% of the constituents of the hydrotreated effluent 112 having boiling point temperatures greater than or equal to the cut point temperature of the hydrotreated effluent separator 120.

The greater boiling hydrotreated effluent 124 can include at least 95%, at least 98%, or even at least 99% of the asphaltene compounds from the hydrotreated effluent 112. The greater boiling hydrotreated effluent 124 can include at least 95%, at least 98%, or even at least 99% of the polynuclear aromatic compounds and other coke precursors from the hydrotreated effluent 112. The greater boiling hydrotreated effluent 124 is passed to the adsorption unit 140 and the lesser boiling hydrotreated effluent 122 is passed directly from the hydrotreated effluent separator 120 to the hydrocracking unit 150.

The light gas stream 121 can include excess hydrogen from the hydrotreating unit 110 as well as any light gases produced in the hydrotreating unit 110, such as but not limited to hydrogen sulfide ($H_2S$), methane ($CH_4$), ammonia ($NH_3$), or combinations of these. Other sulfur-containing gases or nitrogen-containing gases may also be removed in the light gas stream 121. The light gas stream 121 can be passed to one or more downstream treatment systems for further processing, such as recovery of hydrogen or treatment of $H_2S$ and $NH_3$.

As previously discussed, the hydrotreated effluent 112 can have a concentration of constituents having boiling point temperatures greater than 540° C. of from 5 wt. % to 20 wt. %, such as from 10 wt. % to 15 wt. % based on the total weight of the hydrotreated effluent 112. Nearly all of the asphaltene compounds and polyaromatic compounds are in the portion of the hydrotreated effluent 112 having boiling point temperatures greater than 540° C. Thus, separating the hydrotreated effluent 112 into the lesser boiling hydrotreated effluent 122 and the greater boiling hydrotreated effluent 124 can reduce the volume of hydrocarbons subjected to the solvent assisted adsorption process, which can reduce the usage of light paraffin solvent 132 and reduce the size of the adsorption unit 140. Passing only the greater boiling hydrotreated effluent 124 to the solvent assisted adsorption unit can decrease the size of the adsorption unit by up to 85%.

A lesser boiling outlet of the hydrotreated effluent separator 120 can be in direct fluid communication with the hydrocracking unit 150 to bypass the lesser boiling hydrotreated effluent 122 around the adsorption unit 140 and directly from the hydrotreated effluent separator 120 to the hydrocracking unit 150. Separating the lesser boiling constituents out into the lesser boiling hydrotreated effluent 122, bypassing the lesser boiling hydrotreated effluent 122 around the adsorption unit 140, and passing the lesser boiling hydrotreated effluent 122 directly to the hydrocracking unit 150 can reduce the amount of the lesser boiling constituents that would be incidentally adsorbed onto the absorbents in the adsorption unit 140 and lost. Bypassing the lesser boiling hydrotreated effluent 122 around the adsorption unit 140 and directly to the hydrocracking unit 150 can reduce the loss of the lesser boiling constituents by from 1% to 3% by weight based on the total weight of the lesser boiling hydrotreated effluent 122. Thus, passing the lesser boiling hydrotreated effluent 122 directly to the hydrocracking reactor 150 and not through the adsorption unit 140 can increase the yield of greater value chemical products and intermediates compared to subjecting the entire hydrotreated effluent 112 to the adsorption unit 140.

Referring again to FIG. 1, the greater boiling hydrotreated effluent 124 is passed to the solvent-assisted adsorption system, where the greater boiling hydrotreated effluent 124 is combined with a light paraffin solvent 132 to produce a combined stream 134 and the combined stream 134 is passed through the adsorption unit 140. The light paraffin solvent 132 comprises, consists of, or consists essentially of one or more $C_3$-$C_7$ paraffin solvents. The light paraffin solvent 132 can be solvents in which the asphaltenes are non-soluble or have reduced solubility compared to the solubility of the asphaltenes in the greater boiling hydrotreated effluent 124. $C_3$-$C_7$ paraffin solvents are saturated hydrocarbon compounds having from 3 to 7 carbon atoms. The light paraffin solvent 132 can include propane, butane, pentane, hexane, heptane, isomers of these, or combinations of these $C_3$-$C_7$ paraffin solvents. When the number of carbon atoms in the light paraffin solvent 132 is greater than 7, the asphaltene compounds may become at least partially soluble in the light paraffin solvent 132, which can increase the amount of the asphaltene compounds that pass through the adsorption unit 140 to the hydrocracking unit 150. In embodiments, the light paraffin solvent 132 can comprise propane. In embodiments, the light paraffin solvent 132 can comprise $C_5$ paraffins. The light paraffin solvent 132 can include fresh light paraffin solvent 136, recycled light paraffin solvent 178 recovered from the process downstream of the adsorption unit 140, or combinations of these. The light paraffin solvent 132 can include greater than or equal to 80 wt. %, greater than or equal to 90 wt. %, greater than or equal to 95 wt. %, or even greater than or equal to 98 wt. % $C_3$-$C_7$ paraffin solvents based on the total weight of the light paraffin solvent 132.

The greater boiling hydrotreated effluent 124 can be combined with an amount of the light paraffin solvent 132 that is sufficient to reduce the solubility of the asphaltenes in the combined stream 134 and reduce the viscosity of the combined stream 134 compared to the greater boiling hydrotreated effluent 124. The weight ratio of light paraffin solvent 132 to greater boiling hydrotreated effluent 124 can be from 2:3 to 60:1, such as from 2:3 to 20:1, from 2:3 to 10:1, from 3:1 to 60:1, from 3:1 to 20:1, from 3:1 to 10:1, from 4:1 to 60:1, from 4:1 to 20:1, from 4:1 to 10:1, from 10:1 to 60:1, from 10:1 to 20:1, or from 20:1 to 90:1.

Combining the greater boiling hydrotreated effluent 124 with the light paraffin solvent 132 reduces the solubility of the asphaltenes in the greater boiling hydrotreated effluent 124, which can aid in separating the asphaltenes and polyaromatic compounds from the greater boiling hydrotreated effluent 124 through precipitation and agglomeration, leading to rapid settling. This makes it easier to selectively adsorb the asphaltene, polynuclear aromatic compounds, and other coke precursors in the adsorption unit 140. Additionally, the light paraffin solvent 132 dilutes the greater boiling hydrotreated effluent 124, which reduces the viscosity of the combined stream 134 compared to the greater boiling hydrotreated effluent 124. Greater viscosity can lead to more oil molecules that are adsorbed onto the surfaces of the adsorbent in the adsorption unit 140, which increases the loss of non-asphaltene hydrocarbons and non-polynuclear aromatic hydrocarbons and increases the switch rate of the adsorption unit 140. Thus, dilution of the greater boiling hydrotreated effluent 124 with the light paraffin solvent 132 to reduce the viscosity can reduce loss of hydrocarbons through adsorption of non-asphaltene and non-polynuclear aromatic compounds in the adsorption unit 140, decrease the saturation rate of the adsorbents in the adsorption unit 140, and reduce the switch rate of the adsorption unit 140.

Reducing adsorption of non-asphaltene and non-polynuclear aromatic compounds in the adsorption unit 140 through addition of the light paraffin solvent 132 can increase the overall product yield from the system 100 from about 95% to greater than or equal to 98%. Additionally, reducing adsorption of non-asphaltene and non-polynuclear aromatic compounds in the adsorption unit 140 can reduce the switch frequency of the adsorption unit 140, where the switch frequency is the frequency at which a first set of adsorption zones become saturated and flow of the combined stream 134 is switched to a second set of adsorption zones while the first set of adsorption zones is regenerated. In embodiments, the switch frequency of the adsorption unit 140 without addition of the light paraffin solvent 132 can be 2.5 times greater than or equal to the switch frequency of the adsorption unit 140 operated with the addition of the light paraffin solvent 132 to the greater boiling hydrotreated effluent 124.

Referring again to FIG. 1, in embodiments, the solvent assisted adsorption system can include a solvent mixing vessel 130 disposed downstream of the hydrotreated effluent separator 120. The solvent mixing vessel 130 can be fluidly coupled to the hydrotreated effluent separator 120 so that the greater boiling hydrotreated effluent 124 can be passed directly from the hydrotreated effluent separator 120 to the solvent mixing vessel 130. The light paraffin solvent 132 can be passed directly to the solvent mixing vessel 130 or can be combined with the greater boiling hydrotreated effluent 124 upstream of the solvent mixing vessel 130.

In embodiments, the solvent mixing vessel 130 can be a continuously stirred tank reactor (CSTR) comprising a mixing device, such as but not limited to an agitator, mixer, or other device, disposed in a reactor vessel. The solvent mixing vessel 130 can have a volume that provides a residence time sufficient to produce the combined stream 134 that is a homogeneous mixture of the greater boiling hydrotreated effluent 124 and the light paraffin solvent 132. The solvent mixing vessel 130 can have a volume that provides a residence time great enough for precipitation and agglomeration of the asphaltene compounds to occur before passing the combined stream 134 to the adsorption unit 140. The solvent mixing vessel 130 may have an outlet for passing the combined stream 134 out of the solvent mixing vessel 130. The outlet of the solvent mixing vessel 130 can be in fluid communication with the adsorption unit 140 so that the combined stream 134 can be passed directly from the solvent mixing vessel 130 to the adsorption unit 140.

Referring again to FIG. 2, in embodiments, the light paraffin solvent 132 can be mixed with the greater boiling hydrotreated effluent 124 by combining a stream of the light paraffin solvent 132 with the stream of the greater boiling hydrotreated effluent 124 upstream of the adsorption unit 140. The two streams then mix to form the combined stream 134 as the materials are transported through the piping to the adsorption unit 140. In embodiments, the greater boiling hydrotreated effluent 124 and light paraffin solvent 132 may be combined in-line without utilizing the solvent mixing vessel 130.

The combined stream 134 can be a homogeneous mixture of the light paraffin solvent 132 and the greater boiling hydrotreated effluent 124. The combined stream 134 can include from 40 wt. % to 98 wt. % light paraffin solvent based on the total weight of the combined stream 134, such as from 40 wt. % to 95 wt. %, from 40 wt. % to 90 wt. %, from 40 wt. % to 80 wt. %, from 60 wt. % to 98 wt. %, from 60 wt. % to 95 wt. % from 60 wt. % to 90 wt. %, from 60 wt. % to 80 wt. %, from 80 wt. % to 98 wt. %, from 80 wt. % to 95 wt. %, from 80 wt. % to 90 wt. %, from 90 wt. % to 98 wt. %, from 90 wt. % to 95 wt. %, or even from 95 wt. % to 98 wt. % light paraffin solvent based on the total weight of the combined stream 134. The presence of the light paraffin solvent 132 reduces the solubility of asphaltenes and other polyaromatic compounds in the combined stream 134. Thus, the solubility of asphaltenes in the combined stream 134 may be less than a solubility of the asphaltenes in the greater boiling hydrotreated effluent 124. The presence of the light paraffin solvent in the combined stream 34 can reduce the solubility of the asphaltene compounds in the combined stream 134 by greater than or equal to 35%, greater than or equal to 50%, greater than or equal to 70%, or even greater than or equal to 80% compared to the solubility of the asphaltenes in the greater boiling hydrotreated effluent 124 without the light paraffin solvent 132. This reduced solubility can cause the asphaltenes to precipitate out of the liquid phase and can increase agglomeration of asphaltene particles. The combined stream 134 can be a multi-phase stream comprising a liquid phase and precipitated solids. The precipitated solids can include the asphaltenes precipitated out of the liquid phase by the difference in solubility provided by the light paraffin solvent 132. The precipitated solids can also include polynuclear aromatic compounds or other coke precursors. The liquid phase can include a homogeneous mixture of the light paraffin solvent 132 and the remaining liquid components of the greater boiling hydrotreated effluent 124.

The light paraffinic solvent 132 reduces the viscosity of the greater boiling hydrotreated effluent 124. The combined stream 134 can also have a viscosity that is less than the viscosity of the greater boiling hydrotreated effluent 124.

Referring again to FIG. 1, the system 100 includes the adsorption unit 140 operable to remove asphaltenes and other coke precursors from the combined stream 134. The adsorption unit 140 is disposed downstream of the hydrotreated effluent separator 120. As shown in FIG. 1, the adsorption unit 140 can be disposed between the hydrotreated effluent separator 120 and the hydrocracking unit 150. In embodiments, the system 100 includes the solvent mixing vessel 130 and the adsorption unit 140 is disposed downstream of the solvent mixing vessel 130. As previously discussed, the adsorption unit 140 can be fluidly coupled to the outlet of the solvent mixing vessel 130 to pass the combined stream 134 from the solvent mixing vessel 130 directly to the adsorption unit 140. In embodiments, the adsorption unit 140 can be in direct fluid communication with an outlet of the hydrotreated effluent separator 120 so that the greater boiling hydrotreated effluent 124 can be combined with the light paraffin solvent 132 in-line and passed directly to the adsorption unit 140.

Referring again to FIG. 1, the adsorption unit 140 can include a plurality of adsorbent beds or columns, which are referred to herein as adsorption zones. In embodiments, the adsorption unit 140 can include at least a first adsorption zone 142 and a second adsorption zone 144, which can be arranged in parallel. The adsorption unit 140 is depicted in FIG. 1 as having two adsorption zones for ease of illustration and description. However, the adsorption unit 140 can have greater than or equal to two adsorption zones, such as 2, 3, 4, 5, 6, 7, 8, or more than 8 adsorption zones. Each adsorption zone 142, 144 comprises adsorbent materials capable of selectively adsorbing asphaltenes, polynuclear aromatic compounds, other coke precursors, and combinations of these from the combined stream 134. Adsorbent materials suitable for the adsorption unit 140 can include, but are not limited to spherical alumina, clay, metal nanoparticles, or combinations of these. The adsorbent materials can be pelletized. The adsorbent materials can have a pore volume sufficient to allow larger organic molecules, such as asphaltenes and polynuclear aromatic compounds to adsorb into the pores. The adsorbent materials can have a total pore volume of greater than or equal to 1.0 milliliters per gram (ml/g), such as greater than or equal to 1.1 ml/g or greater than or equal to 1.5 ml/g. The adsorbent materials can have a total pore volume of from 1.0 ml/g to 3.0 ml/g, such as from 1.1 ml/g to 3.0 ml/g, or even from 1.5 ml/g to 3.0 ml/g.

The adsorbent materials can have an uptake of asphaltenes of greater than or equal to 5 grams of asphaltenes per gram of adsorbent material, such as from 5 grams to 20 grams of asphaltenes per gram of adsorbent material. The uptake of asphaltenes for the adsorbent materials can be determined by saturating the adsorbent with asphaltenes and then desorbing the asphaltenes and comparing the relative weight. The adsorbent materials can be saturated by monitoring an asphaltene concentration in the effluent exiting the adsorption unit 140. The adsorbent materials are considered saturated when the asphaltene concentration in the effluent from the adsorption unit suddenly increases. Once the adsorbent becomes saturated, the adsorption unit can be washed with straight-run diesel for four hours. The adsorbent is then be unloaded from the adsorption unit 120. 100 grams of the saturated adsorbent is weighed out, then washed with toluene and calcined in a furnace maintained at 700° C. for 8 hours with air flow. After calcination, the adsorbent sample is re-weighed. The uptake of asphaltenes can be calculated as the difference between the initial 100 gram sample of saturated adsorbent and the final weight of the adsorbent after the asphaltenes have all been removed through washing and calcination.

Referring again to FIG. 1, during operation of the adsorption unit 140, the combined stream 134 is passed through one or more of the adsorption zones, such as the first adsorption zone 142, the second adsorption zone 144, or both, in which the combined stream 134 is contacted with the adsorbent materials. Contact of the combined stream 134 with the adsorbent materials in the adsorption unit 140 can cause at least a portion of the asphaltenes, coke precursors, or both, to adsorb into the adsorbent materials. The adsorption unit 140 can be operated at the operating conditions of the unit operation upstream of the adsorption unit 140. When the adsorption unit 140 is positioned downstream of the solvent mixing vessel 130, the adsorption unit 140 can be operated at the temperature and pressure of the solvent mixing vessel 130. When the adsorption unit 140 is disposed directly downstream of the hydrotreated effluent separator 120, the adsorption unit 140 can be operated at a temperature near the operating temperature of the hydrotreated effluent separator 120, such as at a temperature of from 450° C. to 550° C., or from 490° C. to 540° C. In embodiments, the adsorption unit 140 can be operated at a temperature of from 300° C. to 550° C., such as from 300° C. to 540° C., from 300° C. to 490° C., from 300° C. to 450° C., from 350° C. to 550° C., from 350° C. to 540° C., from 350° C. to 490° C. from 350° C. to 450° C., or from 350° C. to 420° C. The adsorption unit 140 can be operated at a pressure of from 50 bar (5,000 kPa) to 200 bar (20,000 kPa), such as from 130 bar (13,000 kPa) to 160 bar (16,000 kPa). The adsorption unit 140 can operate with a liquid hourly volume space velocity (LHSV) of from 5 per hour ($hr^{-1}$) to 10 $hr^{-1}$.

An adsorption effluent 146 is passed out of the adsorption unit 140. The adsorption effluent 146 has a reduced concentration of asphaltenes and other coke precursors compared to the combined stream 134 passed into the adsorption unit 140. The adsorption unit 140 can remove greater than or equal to 95 percent (%) of the asphaltenes from the combined stream 134 to produce the adsorption effluent 146. The adsorption unit 140 can be operable remove greater than or equal to 95% or even greater than or equal to 98% of the asphaltenes from the combined stream 134. In embodiments, the adsorption effluent 146 can have less than or equal to 0.3 wt. %, less than or equal to 0.1 wt. %, less than or equal to 0.05 wt. %, less than or equal to 0.02 wt. %, or even less than or equal to 0.01 wt. % asphaltenes based on the total weight of the adsorption effluent 146. The adsorption effluent 146 can include at least 90%, at least 95%, at least 98%, or even at least 99% of the light paraffin solvent 132 from the combined stream 134. The adsorption effluent 146 can include at least 80%, at least 90%, at least 95%, at least 98%, or even at least 99% of the non-asphaltene hydrocarbons from the greater boiling hydrotreated effluent 124. In embodiments, less than or equal to 1 wt. % of the non-asphaltene compounds from the greater boiling hydrotreated effluent 124 are adsorbed onto the adsorbent materials in the adsorption unit 140, where the weight percent is based on the total weight of the greater boiling hydrotreated effluent 124 in the combined stream 134. For comparison, when the greater boiling hydrotreated effluent 124 is passed through the adsorption unit 140 without the light paraffin solvent 132, the loss of non-aspaltene hydrocarbons to adsorption onto the adsorbent materials can be from 2 wt. % to 4 wt. % based on the total weight of the greater boiling hydrotreated effluent 124.

Removal of the asphaltenes, polynuclear aromatic compounds, and other coke precursors from the combined stream 134 can reduce buildup of asphaltenes, coke, or both, on the surfaces of the hydrocracking catalysts in the hydrocracking unit 150, which can reduce deactivation of the hydrocracking catalysts and improve the service life of the hydrocracking catalysts. In embodiments, solvent-assisted adsorption of asphaltene compounds and coke precursors can increase the useful service life of the hydrocracking catalyst by a factor of greater than or equal to 2, greater than or equal to 3, or even greater than or equal to 4. The useful service life of the hydrocracking catalyst is the elapsed time between startup of the hydrocracking unit 150 with new hydrocracking catalyst and shutdown of the hydrocracking unit 150 to replace the deactivated hydrocracking catalyst.

The time at which the hydrocracking unit 150 is shut down to replace the catalyst can depend on the temperature limits of the materials of construction of the reactor as well as thermodynamic constraints on selectivity and yield. Due to construction material constraints for hydroprocessing reactors, the reaction temperature in the hydrocracking unit 150 is generally limited to about 440° C. As the hydrocracking catalyst gradually deactivates, the reaction temperature can be increased to maintain the desired product yield or quality. When the temperature reaches the maximum allowable temperature of the hydrocracking reactor based on the materials of construction (440° C.) and the desired product yield or quality can no longer be obtained without further increase in the temperature, the hyrocracking unit 150 needs to be shut down to replace the spent hydrocracking catalyst with fresh hydrocracking catalyst.

Additionally, the time at which the hydrocracking catalyst needs to be changed can depend on limitations related to product yield and quality specifications. As the temperature increases, the product selectivity changes and ultimately a thermodynamic limit is reached. The thermodynamic limit is the point at which the product yield or product quality cannot meet the product specifications. In some cases, this thermodynamic limit occurs at a temperature of the hydrocracking unit 150 less than the maximum temperature allowed by the materials of the hydrocracking unit 150 (<440° C.). At this point, the hydrocracking unit 150 is shut down for replacement of the hydrocracking catalyst. For example, for a hydrocracking unit 150 to produce ultra-low sulfur diesel (ULSD), when the temperature reaches a certain level, due to thermodynamic limitations, the sulfur conversion decreases and the product effluent cannot meet the product specifications (<15 ppm). In this case, the hydrocracking unit has to be shut down to change the catalysts.

Reducing deactivation of the hydrocracking catalysts can also increase the conversion of hydrocarbons from the hydrocarbon feed 102 to yield greater value chemical products and intermediates, such as $C_1$ to $C_4$ hydrocarbons and other hydrocarbons having boiling point temperatures less than or equal to 180° C. Removal of the asphaltenes, coke precursors, or both, may also reduce buildup of asphaltenes, coke, or both on downstream equipment, such as but not limited to downstream separation units.

As previously discussed, the adsorption unit 140 can include a plurality of adsorption zones, such as the first adsorption zone 142, the second adsorption zone 144, and any additional adsorption zones, which may be arranged in parallel. The adsorption unit 140 may be operated in a swing mode in which the combined stream 134 is passed through a first subset of the plurality of adsorption zones. When the first subset of adsorption zones becomes saturated with asphaltenes, coke precursors, or both, the flow of the combined stream 134 through the adsorption unit 140 can be transitioned to a second subset of adsorption zones to allow the first subset of absorbent beds to be regenerated. For example, in reference to FIG. 1, the combined stream 134 can be passed through the first adsorption zone 142 until the adsorbent materials in the first adsorption zone 142 become saturated with asphaltenes, coke precursors, or both, and are no longer effective to remove further asphaltenes from the combined stream 134. Flow of the combined stream 134 can then be switched over to the second adsorption zone 144 while the first adsorption zone 142 is regenerated.

The adsorbent beds, such as the first adsorption zone 142 and the second adsorption zone 144, can be regenerated by passing a regenerating solvent through the adsorption zone, the regenerating solvent being capable of desorbing and dissolving the asphaltenes and coke precursors from the adsorbent materials. Suitable regenerating solvents for regenerating the adsorbent beds can include, but are not limited to, aromatic solvents such as toluene, benzene, or a mixture of both. Other solvents or materials capable of dissolving asphaltenes may also be used as the regenerating solvent to regenerate the adsorbent beds. In embodiments, the regenerating solvent can be an aromatics-rich stream from a catalytic cracking unit, such as but not limited to a light cycle oil (LCO) stream, or an aromatics-rich stream from steam cracking, such as but not limited to light pyoil. Other solvents may include alkyl alcohols, halogenated hydrocarbons, aromatic compounds, or combinations of these. The regenerating solvents for regenerating the adsorbent materials in the adsorption zones of the adsorption unit 140 do not include the light paraffin solvents, such as $C_3$-$C_7$ paraffin solvents, due to the reduced solubility of the asphaltenes in the $C_3$-$C_7$ paraffin solvents.

Referring again to FIG. 1, the adsorption effluent 146 can be passed from the adsorption unit 140 to the hydrocracking unit 150 disposed downstream of the adsorption unit 140. In embodiments, the adsorption unit 140 can have an outlet in direct fluid communication with an inlet of the hydrocracking unit 150 so that the adsorption effluent 146 can be passed directly from the adsorption unit 140 to the hydrocracking unit 150. In embodiments, the adsorption effluent 146 can be combined with the lesser boiling hydrotreated effluent 122 from the hydrotreated effluent separator 120 to produce a hydrocracker feed 148 upstream of the hydrocracking unit 150. In embodiments, the lesser boiling hydrotreated effluent 122 can be passed separately and independently to the hydrocracking unit 150 and mixed with the adsorption effluent 146 in the hydrocracking unit 150.

Referring again to FIG. 1, the hydrocracker feed 148, which can comprise the lesser boiling hydrotreated effluent 122 and at least a portion of the adsorption effluent 146, is then passed to the hydrocracking unit 150, which is disposed downstream of the hydrotreating unit 110 and the adsorption unit 140. Hydrogen 104 can also be introduced to the hydrocracking unit 150 with the hydrocracker feed 148. The hydrogen 104 can be recycled hydrogen recovered from the system 100, such as excess hydrogen recovered from the hydrotreated effluent separator 120, excess hydrogen recovered from hydrocracked effluent separation system 160, or both. The hydrogen 104 can also include supplemental hydrogen from an external hydrogen source (not shown). The hydrogen 104 can be passed directly to the hydrocracking unit 150 or combined with the hydrocracker feed 148 upstream of the hydrocracking unit 150.

The hydrocracking unit 150 is operable to contact the hydrocracker feed 148 with hydrogen 104 in the presence of at least one hydrocracking catalyst in a hydrocracking zone 152 at reaction conditions that cause at least a portion of the hydrocarbons in the hydrocracker feed 148 to undergo hydrocracking reactions to produce a hydrocracked effluent 154. The hydrocracked effluent 154 has an increased concentration of hydrocarbons having boiling point temperatures less than or equal to 180° C. compared to the hydrocracker feed 148. The hydrocracking unit 150 can include at least one hydrocracking catalyst in the hydrocracking zone 152. In the hydrocracking unit 150, saturated polyaromatic compounds and other greater molecular weight hydrocarbons in the hydrocracker feed 148 can be converted to smaller, lesser-boiling hydrocarbons through contact of the hydrocracker feed 148 with hydrogen 104 in the presence of the hydrocracking catalyst. The hydrocracking unit 150 can be any type of reactor operable to contact the hydrocracker feed 148 with the hydrocracking catalyst in the hydrocracking zone 152. Suitable reactors for the hydrocracking unit 150 can include, but are not limited to, fixed bed reactors, moving bed reactors, ebullated bed reactors, slurry bed reactors, fluidized bed reactors, plug flow reactors, other type of reactor, or combinations of reactors. For example, the hydrocracking unit 150 can include one or more fixed bed reactors, which may be operated in downflow, upflow, or horizontal flow configurations.

The hydrocracking catalyst can be a solid particulate catalyst capable of promoting or increasing the reaction rate of cracking reactions of hydrocarbons in the presence of hydrogen. Suitable hydrocracking catalysts can include, but are not limited to, zeolite catalysts. Examples of zeolite catalysts suitable for use as the hydrocracking catalyst can include, but are not limited to, Y-type zeolites, REY-type zeolites, USY-type zeolties, RE-USY-type zeolites, mordenite framework inverted (MFI) type zeolites, beta zeolites, or combinations of these. The hydrocracking catalyst may be a hierarchical zeolite containing hydrocracking catalyst, such as but not limited to a hierarchical beta zeolite, a hierarchical Y-zeolite, or other hierarchical zeolite. Hierarchical zeolites may refer to zeolites that have a hierarchical pore structure. The hierarchical zeolites can have an average pore size of from 2 nm to 40 nm, or from 5 nm to 25 nm as determined using the Barrett-Joyner-Halinda (BJH) method. Hierarchical zeolites can be prepared by subjecting a microporous beta zeolite or Y-zeolite to a desilication process or by synthesizing the beta zeolite or Y-zeolite using a templating agent or pore-directing agent to achieve the desired hierarchical pore structure.

The hydrocracking catalyst in the hydrocracking unit 150 can additionally include one or a plurality of metals supported on the surfaces of the zeoltites. The hydrocracking catalysts can include one or a plurality of metals selected from the metallic elements in Groups 6, 7, 8, 9, or 10 of the IUPAC periodic table supported on the zeolite or hierarchical zeolite. Example metals for the hydrocracking catalysts can include but are not limited to molybdenum, cobalt, tungsten, nickel, platinum, palladium, or combinations of these. In embodiments, the hydrocracking catalyst can include nickel and molybdenum supported on a Y-zeolite or beta zeolite support. In one or more embodiments, the hydrocracking catalyst can include nickel and tungsten supported on a Y-zeolite or beta zeolite support. In embodiments, the hydrocracking catalyst in the hydrocracking unit 150 can include platinum and palladium supported on a Y-zeolite or beta zeolite support.

The hydrocracking unit 150 can be operated under reaction conditions that promote or increase the reaction rate of the hydrocracking reactions to produce the hydrocracked effluent 154 having increased concentrations of smaller, lesser-boiling hydrocarbons, such as but not limited to $C_2$ to $C_{10}$ paraffins and other hydrocarbons having boiling temperatures less than or equal to 180° C. (naphtha). The hydrocracker feed 148 can be contacted hydrogen 104 and the hydrocracking catalyst in the hydrocracking unit 150 at a hydrocracking temperature and hydrocracking pressure sufficient to crack at least a portion of the larger hydrocarbons in the hydrocracker feed 148 to produce smaller, lesser-boiling hydrocarbons having boiling point temperatures less than or equal to 180° C. The hydrocracking unit 150 can be operated at a hydrocracking temperature of from 300° C. to 450° C., such as from 350° C. to 420° C. The hydrocracking unit 150 can be operated at a hydrocracking pressure of from 50 bar (5,000 kPa) to 200 bar (20,000 kPa), such as from 130 bar (13,000 kPa) to 160 bar (16,000 kPa). The hydrocracking unit 150 can operate with a liquid hourly volume space velocity (LHSV) of from 0.1 per hour ($h^{-1}$) to 3 $h^{-1}$, such as from 0.2 $h^{-1}$ to 2 $h^{-1}$ or even from 0.2 $h^{-1}$ to 0.7 $h^{-1}$. The volume ratio of hydrogen 104 to the hydrocracker feed 148 introduced to the hydrocracking unit 150 can be from 800:1 to 1200:1.

Referring again to FIG. 2, in embodiments, the hydrocracking unit 150 can include at least one supplemental hydrotreating zone 151 upstream of the hydrocracking zone 152. The supplemental hydrotreating zone 151 can include a hydrotreating catalyst, such as any of the hydrotreating catalysts previously described in the present disclosure. For example, in embodiments, the hydrotreating catalyst in the supplemental hydrotreating zone 151 can be a catalyst comprising nickel and molybdenum or cobalt and molybdenum supported on an alumina catalyst support. The supplemental hydrotreating zone 151 can be disposed in the same reactor as the hydrocracking zone 152 and upstream of the hydrocracking zone 152 or can be disposed in a separate reactor directly upstream of the reactor comprising the hydrocracking zone 152.

The hydrocracked effluent 154 can have a greater concentration of $C_1$-$C_4$ hydrocarbons and hydrocarbons having boiling point temperatures less than or equal to 180° C. compared to the hydrocracker feed 148. The hydrocracked effluent 154 can also include excess hydrogen from the hydrocracking unit 150 and by-product gases from the hydrotreating and hydrocracking processes. In embodiments, the hydrocracked effluent 154 can have less than or equal to 2 wt. %, less than or equal to 1 wt. %, less than or equal to 0.5 wt. %, or even less than or equal to 0.1 wt. % hydrocarbons having boiling point temperatures greater than 540° C.

When the adsorption effluent 146 is passed directly to the hydrocracking unit 150, the light paraffin solvent is also passed to the hydrocracking unit 150. The light paraffin solvent can pass through the hydrocracking unit 150 and be present in the hydrocracked effluent 154. The light paraffin solvent can then be separated from the hydrocracked effluent 154, recovered, and recycled back to combine with the greater boiling hydrotreated effluent 124, as discussed further in the present disclosure.

Referring again to FIG. 1, the hydrocracked effluent 154 can be passed to the hydrocracked effluent separation system 160 disposed downstream of the hydrocracking unit 150. The hydrocracked effluent separation system 160 can have an inlet in direct fluid communication with the outlet of the hydrocracking unit 150 to pass the hydrocracked effluent 154 directly from the hydrocracking unit 150 to the hydrocracked effluent separation system 160.

The hydrocracked effluent separation system 160 can be operable to separate the hydrocracked effluent 154 to produce at least one gaseous product effluent 164 and at least one liquid product effluent 174. The hydrocracked effluent separation system 160 can also operate to separate the light paraffin solvent from the hydrocracked effluent 154 to produce a recovered light paraffin solvent 172. The hydrocracked effluent separation system 160 can include one or a plurality of separation units, which, collectively, operate to separate the hydrocracked effluent 154 into one or more gaseous product streams 164, one or more liquid product stream 174, the recovered light paraffin solvent 172, or combinations of these.

Referring again to FIG. 1, in embodiments, the hydrocracked effluent separation system 160 can include a first separator 162 and a second separator 170 downstream of the first separator 162. The first separator 162 can include a high-pressure separator, a low-pressure separator, or both. The first separator 162 may be operable to separate the hydrocracked effluent 154 into one or more of the gaseous product streams 164 and a liquid stream 166.

The gaseous product streams 164 can include light hydrocarbon gases produced in the hydrocracking unit 150 as well as excess hydrogen or other by-product gases. The light hydrocarbon gases can include methane, ethane, propane, ethylene, propylene, mixed butenes, or combinations of these. The gaseous product streams 164 can include the excess hydrogen from the hydrocracking unit 150. Additionally, the gaseous product streams 164 can further include by-product gases produced as a by-product of hydrotreating in the hydrotreating unit 110 or hydrocracking unit 150. By-product gases can include, but are not limited to sulfur-containing gases such as hydrogen sulfide, nitrogen-containing gases such as ammonia, or combinations of these. The gaseous product streams 164 can be passed to one or more downstream treatment units for further processing, such as recovery of hydrogen, treatment of by-product gases, separation and purification of product hydrocarbon gases, further conversion of product hydrocarbon gases to other petrochemical products and intermediates, or combinations of these.

The liquid stream 166 from the first separator 162 can be passed to the second separator 170. The second separator 170 can be a fractionator configured to separate the liquid stream 166 into recovered light paraffin solvent 172 and one or more liquid product streams 174. In embodiments, the second separator 170 can include a fractional distillation column configured to separate the liquid stream 166 into the light paraffin solvent 172 and a plurality of liquid product streams 174. The plurality of liquid product streams can include, but are not limited to, a naphtha stream comprising hydrocarbons with boiling point temperatures of less than 180° C., hydrocarbons boiling in the range of from 180° C. to 350° C., hydrocarbons boiling in the range of from 350° C. to 540° C., a residual stream having boiling point temperatures greater than 540° C., or combinations of these.

The recovered light paraffin solvent 172 can include the light paraffin solvents passed to the hydrocracking unit 150 in the adsorption effluent 146 and passed out of the hydrocracking unit 150 in the hydrocracked effluent 154. The recovered light paraffin solvent 172 can include at least 95%, at least 98%, at least 99%, or at least 99.5% of the light paraffin solvent in the hydrocracked effluent 154. All or at least a portion of the recovered light paraffin solvent 172 can be passed back into combination with the greater boiling hydrotreated effluent 124 upstream of the adsorption unit 140. Referring again to FIG. 1, the system 100 can include a light paraffin solvent recycle line 176 that fluidly couples an outlet of the hydrocracked effluent separation system 160 with the greater boiling hydrotreated effluent 124 to passed the recovered light paraffin solvent 172 back to be combined with the greater boiling hydrotreated effluent 124. In embodiments, the light paraffin solvent recycle line 176 can be in fluid communication with the solvent mixing vessel 130 to pass the recovered light paraffin solvent 172 back to the solvent mixing vessel 130 as at least a portion of the light paraffin solvent 132.

Referring again to FIG. 2, in embodiments, the light paraffin solvent can be recovered from the adsorption effluent 146 immediately downstream of the adsorption unit 140 instead of passing the light paraffin solvent through the hydrocracking unit 150. In embodiments, the system 100 can include an adsorption effluent separator 180 directly downstream of the adsorption unit 140. The adsorption effluent separator 180 operates to separate the adsorption effluent 146 to produce a recovered light paraffin solvent 182 and a greater boiling adsorption effluent 184. In embodiments, the adsorption effluent separator 180 can include a flash separator, such as a flash drum, operable to flash off the light paraffin solvent from the adsorption effluent 146 to produce the recovered light paraffin solvent 182. The recovered light paraffin solvent 182 can then be passed back through a light paraffin solvent recycle line 183 to be combined with the greater boiling hydrotreated effluent 124 upstream of the adsorption unit 140. In embodiments, the recovered light paraffin solvent 182 can be condensed back into a liquid prior to combining with the greater boiling hydrotreated effluent 124. The adsorption effluent separator 180 can be in fluid communication with the hydrocracking unit 150 to pass the greater boiling adsorption effluent 184 to the hydrocracking unit 150.

Referring again to FIG. 1, in operation of the system 100, the hydrocarbon feed 102 is passed to the hydrotreating unit 110 along with hydrogen 104. The hydrotreating unit 110 hydrotreats the hydrocarbon feed 102 to produce the hydrotreated effluent 112 having reduced concentrations of one or more of sulfur, nitrogen, metals, polyaromatic compounds, or combinations of these. The hydrotreated effluent 112 is then passed directly to the hydrotreated effluent separator 120 that separates the hydrotreated effluent 112 into the lesser boiling hydrotreated effluent 122 and the greater boiling hydrotreated effluent 124. The greater boiling hydrotreated effluent 124 is combined with the light paraffin solvent 132 to produce the combined stream 134. The greater boiling hydrotreated effluent 124 can be combined with the light paraffin solvent 132 in-line or in the solvent mixing vessel 130 disposed between the hydrotreated effluent separator 120 and the adsorption unit 140.

The combined stream 134 is then passed to the adsorption unit 140. The adsorption unit 140 contacts the combined stream 134 with absorbents that remove at least a portion of the asphaltenes, coke precursors, or both, from the combined stream 134 to produce the adsorption effluent 46. The adsorption unit 140 can remove at least 95% of the asphaltenes from the combined stream 134. In embodiments, the adsorption effluent 146 can then be passed from the adsorption unit 140 to the hydrocracking unit 150. Referring to FIG. 2, in embodiments, the adsorption effluent 146 can be passed to an adsorption effluent separator 180 that separates the adsorption effluent 146 into recovered light paraffin solvent 182 and the greater boiling adsorption effluent 184. The recovered light paraffin solvent 182 can be condensed and passed back into combination with the greater boiling hydrotreated effluent 124. Referring to FIGS. 1 and 2, the adsorption effluent 146 or the greater boiling adsorption effluent 184 can be combined with the lesser boiling hydrotreated effluent 122 to form the hydrocracker feed 148, which is then passed to the hydrocracking unit 150. The hydrocracking unit 150 contacts the hydrocracker feed 148 with hydrogen 104 in the presence of at least one hydrocracking catalyst to hydrocrack at least a portion of the hydrocarbons in the hydrocracker feed 148 to produce the hydrocracked effluent 154, which may have an increased concentration of hydrocarbons having boiling point temperatures less than 180° C. compared to the hydrotreated effluent 112.

The hydrocracked effluent 154 is then passed to the hydrocracked effluent separation system 160. The hydrocracked effluent separation system 160 separates the hydrocracked effluent 154 into at least one gaseous product stream 164 and at least one liquid product stream 174. When the adsorption effluent 146 comprising the light paraffin solvent is sent to the hydrocracking unit 150, the hydrocracked effluent separation system 160 can separate the light paraffin solvent from the hydrocracked effluent 154 to produce the recovered light paraffin solvent 172. The recovered light paraffin solvent 172 can be recycled back into combination with the greater boiling hydrotreated effluent 124.

Referring again to FIG. 1, the system 100 can be used to conduct a process for upgrading the hydrocarbon feed 102. The process includes hydrotreating the hydrocarbon feed 102 to produce the hydrotreated effluent 122, where the hydrotreated effluent 112 comprises asphaltenes, coke precursors, or both. The hydrotreating can be conducted in the hydrotreating unit 110 having any of the features, catalysts, or operating conditions previous described for the hydrotreating unit 110. The process further includes separating the hydrotreated effluent 112 into the lesser boiling hydrotreated effluent 122 and the greater boiling hydrotreated effluent 124, where the greater boiling hydrotreated effluent 124 comprises the asphaltenes, coke precursors, or both. The separating can be conducted in the hydrotreated effluent separator 120, which can have any of the features or operating conditions previously described for the hydrotreated effluent separator 120. The process further includes combining the greater boiling hydrotreated effluent 124 with the light paraffin solvent 132 to produce the combined stream 134 and adsorbing at least a portion of the asphaltenes, coke precursors, or both from the combined stream 134 to produce an adsorption effluent 146. As previously discussed, the light paraffin solvent 132 reduces solubility of the asphaltenes in the combined stream 134 and reduces the viscosity of the combined stream 134. The adsorbing can be conducted in the adsorption unit 140, which can have any of the features, configurations, or operating conditions previously described for the adsorption unit 140. The process further includes hydrocracking the at least a portion of the adsorption effluent 146 and the lesser boiling hydrotreated effluent 122 to produce the hydrocracked effluent 154, which comprises a greater concentration of hydrocarbons having boiling point temperatures less than 180° C. compared to the hydrotreated effluent 112. The hydrocracking can be conducted in the hydrocracking unit 150, which can have any of the features, catalysts, or operating conditions previous described for the hydrocracking unit 150.

The hydrocarbon feed 102 can have any of the compositions or properties previous discussed. In embodiments, the hydrocarbon feed 102 can comprise a whole crude, a desalted whole crude, or a combination thereof. In embodiments, the greater boiling hydrotreated effluent 124 can comprise constituents of the hydrotreated effluent 112 having boiling point temperatures greater than or equal to 540° C. In embodiments, the lesser boiling hydrotreated effluent 122 can be substantially free of asphaltenes, such as having less than or equal to 0.01 wt. % asphaltenes based on the total weight of the lesser boiling hydrotreated effluent 122. In embodiments, the lesser boiling hydrotreated effluent 122 can be passed directly from separating to hydrocracking without being subjected to adsorption.

The light paraffin solvent 132 can have any of the properties or compositions previous described for the light paraffin solvent 132. In embodiments, the light paraffin solvent 132 can be a solvent in which asphaltenes are not soluble. In embodiments, the light paraffin solvent 132 can comprise or consist of saturated hydrocarbons having from 3 to 7 carbon atoms. In embodiments, combining the greater boiling hydrotreated effluent 124 with the light paraffin solvent 132 can include passing the greater boiling hydrotreated effluent 124 and the light paraffin solvent 132 to the solvent mixing vessel 130 that can be a continuous stirred tank reactor. In embodiments, the process can include combining the greater boiling hydrotreated effluent 124 with the light paraffin solvent 132 in-line before the adsorbing. In embodiments, the greater boiling hydrotreated effluent 124 can be combined with the light paraffin solvent 132 without the solvent mixing vessel 130.

Absorbing the at least a portion of the asphaltenes, coke precursors, or both can include contacting the combined stream 134 with an adsorbent, where contact with the adsorbent causes at least a portion of the asphaltene, coke precursors, or both to adsorb onto the adsorbent. The adsorbent can include any of the adsorbent types, properties, or features previously described for the adsorbent. In embodiments, the adsorbent can include at least one of spherical alumina, clay, metal nanoparticles, or combinations of these adsorbents. The process can include regenerating the adsorbent by contacting the adsorbent with an asphaltene dissolving solvent capable of dissolving asphaltenes, coke precursors, or both. The adsorption effluent 146 can have a concentration of asphaltenes, coke precursors, or both that is less than a concentration of asphaltenes, coke precursors, or both in the combined stream 134. In embodiments, the process can include adsorbing at least 95 percent by weight of the asphaltenes, coke precursors, or both, from the combined stream 134.

The processes can further include recovering at least a portion of the light paraffin solvent and recycling the at least a portion of the light paraffin solvent back into combination with the greater boiling hydrotreated effluent 124. Referring to FIG. 2, in embodiments, recovering the light paraffin solvent can include passing the adsorption effluent 146 to the adsorption effluent separator 180 that separates the adsorption effluent 146 into the greater boiling adsorption effluent 184 and the recovered light paraffin solvent 182. In embodiments, the adsorption effluent separator 180 can separate the adsorption effluent 146 by flashing off the recovered light paraffin solvent 182. In embodiments, the process can include separating the adsorption effluent 146 into the recovered light paraffin solvent 182 and the greater boiling adsorption effluent 184. The process can include passing the greater boiling adsorption effluent 184 to the hydrocracking unit 150. The process can include hydrocracking the greater boiling adsorption effluent 184 and the lesser boiling hydrotreated effluent 122. The process can further include passing the recovered light paraffin solvent 182 back into combination with the greater boiling hydrotreated effluent 124. In embodiments, the entire adsorption effluent 146, including the light paraffin solvent, can be passed to the hydrocracking unit 150 and hydrocracked. In these embodiments, recovering the light paraffin solvent can include passing the hydrocracked effluent 154 to the hydrocracked effluent separation system 160 that separates the hydrocracked effluent 154 to produce a recovered light paraffin solvent 172.

The process can further include separating the hydrocracked effluent 154 into one or more gaseous product streams 164, one or more liquid product streams 174, or combinations of these. Hydrotreating the hydrocarbon feed 102 can include contacting the hydrocarbon feed 102 with hydrogen 104 in the presence of at least one hydrotreating catalyst in at least one hydrotreating zone. The hydrotreating can remove one or more metals, nitrogen compounds, sulfur compounds, or combinations of these from the hydrocarbon feed 102 to produce the hydrotreated effluent 112. The process can further include combining the lesser boiling hydrotreated effluent 122 and the adsorption effluent 146 or the greater boiling adsorption effluent 184 to produce the hydrocracker feed 148 and passing the hydrocracker feed 148 to the hydrocracking unit 150. The hydrocracking can include contacting the hydrocracker feed 148 with hydrogen 104 in the presence of the hydrocracking catalyst to produce the hydrocracked effluent 154, where the hydrocracked effluent 154 has a greater concentration of hydrocarbons having boiling point temperatures less than or equal to 180° C. compared to the hydrocracker feed 148.

While the present description and examples are provided in the context of whole crude oil or desalted crude oil as the hydrocarbon feed 102, it should be understood that systems and processes described in the present disclosure may be applicable for the conversion of a wide variety of heavy oils, including, but not limited to, crude oil, vacuum residue, tar sands, bitumen, atmospheric residue, vacuum gas oils, or other heavy oils.

EXAMPLES

The various embodiments of methods and systems for the processing of heavy oils will be further clarified by the following examples. The examples are illustrative in nature, and should not be understood to limit the subject matter of the present disclosure.

Comparative Example 1

In Comparative Example 1, a hydrocarbon feed comprising crude oil was hydrotreated and hydrocracked in a pilot-plant-sized process without solvent assisted adsorption of asphaltenes between hydrotreating and hydrocracking. The crude oil comprising the hydrocarbon feed was an Arab light crude oil, the properties of which are provided in Table 3. In Comparative Example 1, the crude oil was hydrotreated in a pilot-plant-sized hydrotreating unit comprising an HDM catalyst (commercially available as KFR-22 from Albemarle), a transition catalyst (commercially available as KFR-33 from Albemarle), and an HDS catalyst (commercially available as KFR-70 from Albemarle) to reduce the concentration of metals, sulfur, nitrogen, and aromatic compounds in the crude oil. The hydrotreating unit consisted of a packed column with the HDM catalyst bed on the top, the transition catalyst bed in the middle, and the HDS catalyst bed on the bottom. The volume ratio of the HDM catalyst to the transition catalyst to the HDS catalyst was 15:15:70.

The hydrotreated effluent from the hydrotreating unit was subjected to hydrocracking in a pilot-plant-sized hydrocracking reactor. The hydrotreated effluent was passed directly to the hydrocracking reactor without adsorption of asphaltenes. The hydrocracking reactor included a hydrocracking catalyst comprising molybdenum and nickel supported on a hierarchical Y-zeolite. The Y-zeolite had a molar ratio of silica ($SiO_2$) to alumina ($Al_2O_3$) of 60:1. The hierarchical Y-zeolite was prepared by treating USY-zeolite with a basic solution (NaOH or ammonia) in the presence of a structure directing agent to convert the USY-zeolite into the hierarchical Y-zeolite. The hydrotreating and hydrocracking were conducted at a temperature of 390° C. and a pressure of 150 bar. The LHSV was 0.17 per hour and the volume ratio of hydrogen to hydrocarbons was 1200. The hydrocracked effluent was collected and the properties and composition of the hydrotreated effluents were analyzed according to the methods shown in Table 2.

TABLE 2

| Property | Method |
|---|---|
| Density | ASTM D287 |
| Sulfur Content | ASTM D5453 |
| Nitrogen Content | ASTM D4629 |
| C1-C4 Concentration | On-line GC analysis |
| Concentration-C5 to 180° C. | ASTM D7169 |
| Concentration-180° C. to 350° C. | ASTM D7169 |
| Concentration-350° C. to 540° C. | ASTM D7169 |
| Concentration->540 °C. | ASTM D7169 |

Table 3 provides the operating conditions for the hydrotreating and hydrocracking process of Comparative Example 1 as well as the composition of the hydrocracking effluent recovered from the process of Comparative Example 1. Table 3 further includes the properties and composition of the hydrocarbon feed.

Example 2: Modeling of System Including Hydrotreating, Solvent-Assisted Adsorption of Asphaltenes, and Hydrocracking In Example 2, the process comprising hydrotreating the hydrocarbon feed, separating the hydrotreated effluent into the lesser boiling hydrotreated effluent and greater boiling effluent, subjecting the greater boiling hydrotreated effluent to solvent-assisted adsorption, and then hydrocracking the lesser boiling hydrotreated effluent and adsorption effluent is modeled. The hydrocarbon feed for Example 2 has the same composition and properties as the hydrocarbon feed used for Comparative Example 1. The process was modeled using Aspen 6 modeling software. Conversion data for the hydrotreating unit and hydrocracking unit from the pilot scale testing of Comparative Example 1 is used to model conversion and yield in Example 2 at the same operating conditions for the hydrotreating unit and hydrocracking unit described in Comparative Example 1.

The model for Example 2 further includes separation of the hydrotreated effluent in a separator operated at a cut point temperature of 540° C. to produce the lesser boiling hydrotreated effluent and the greater boiling hydrotreated effluent. The model further includes addition of light paraffin solvent to the greater boiling hydrotreated effluent followed by adsorption in an adsorption unit. The adsorption unit is modeled using a separation efficiency set to 90% separation of asphaltenes from the combined stream comprising the greater boiling hydrotreated effluent and light paraffin solvent. The light paraffin solvent is C5 hydrocarbons (pentane and various isomers of pentane) and the solvent to oil ratio is 10:1.

The adsorption effluent from the adsorption unit is combined with the lesser boiling hydrotreated effluent and introduced to the hydrocracking unit along with hydrogen. The light paraffin solvent is removed from the hydrocracked effluent downstream of the hydrocracking unit so that the light paraffin solvent is not included in the composition of the hydrocracked effluent in Table 3 below. Modeling of the system in Example 2 resulted in a hydrocracked effluent (minus the light paraffin solvent) having the composition provided in Table 3.

TABLE 3

| | Hydrocarbon Feed | Hydrocracked Effluent Comparative Example 1 | Hydrocracked Effluent Example 2 |
|---|---|---|---|
| Operating Conditions | | | |
| LHSV ($h^{-1}$) | — | 0.17 | 0.17 |
| Temperature (° C.) | — | 390 | 390 |
| Pressure (bar) | — | 150 | 150 |
| Volume ratio $H_2$/hydrocarbon | — | 1200 | 1200 |
| Properties | | | |
| Density | 0.8658 | 0.8196 | 0.8022 |
| Sulfur content (ppmw) | 18030 | 34.5 | 10 |
| Nitrogen content (ppmw) | 844.1 | 32.45 | <1 |
| Yield (%) | | | |
| C1-C4 | — | 2.48 | 7.56 |
| C5-180° C. | 21.04 | 31.73 | 44.24 |
| 180° C.-350° C. | 31.10 | 42.74 | 36.14 |
| 350° C.-540° C. | 33.27 | 17.75 | 10.25 |
| >540° C. | 14.59 | 3.47 | 0.00 |
| Total Yield (%) | 100.00 | 98.17 | 98.19 |
| Predicted hydrocracking catalyst life (years) | — | 0.5 | 2-5 |

The testing and modeling results in Table 3 show that adding the solvent-assisted adsorption of the asphaltenes in Example 2 results in complete conversion of the fraction of hydrocarbons boiling above 540° C. to lesser boiling components as shown by the 0.0% yield for >540° C. boiling hydrocarbons. In comparison, the hydrocracked effluent of Comparative Example 1 produced through hydrotreating and hydrocracking without solvent-assisted adsorption showed a yield for >540° C. boiling hydrocarbons of 3.47%, which demonstrates that a significant portion of the hydrocarbons boiling above 540° C. from the feed are not converted to lesser boiling constituents. Further, the process modeled in Example 2, which included the solvent assisted adsorption of asphaltenes, produces a greater yield of $C_1$-$C_4$ hydrocarbons and hydrocarbons boiling at temperatures between $C_5$ and 180° C. Thus, more light boiling fractions are produced from the process when the solvent-assisted adsorption of asphaltenes is included.

The hydrocracking catalyst life for Comparative Example 1 and Example 2 are predicted based on catalyst deactivation rate data, temperature limits of the materials of construction of hydrocracking units, and the thermodynamics of the hydrocracking reactions for the light Arab crude oil. The results for the predicted hydrocracking catalyst life are reported in Table 3. As shown in Table 3, the predicted hydrocracking catalyst life for the process of Example 2 comprising the solvent-assisted adsorption of asphaltenes is at least four times greater than the predicted hydrocracking catalyst life of the process in Comparative Example 1, which did not include the solvent-assisted adsorption of aphaltenes. Thus, the inclusion of the solvent-assisted adsorption of asphaltenes can increase the usable life of the hydrocracking catalyst, which reduces the frequency at which the hydrocracker must be shut down to change the catalyst. This results in smoother and more continuous operation of the system.

Example 3—Adsorption without Addition of Light Paraffin Solvent

In Example 3, a process similar to the process of Example 2 is modeled except that the adsorption is conducted without the addition of the light paraffin solvent to the greater boiling hydrotreated effluent upstream of the adsorption unit. The total product yield, liquid hourly space velocity through the adsorption unit, and the relative adsorption zone switch frequency are provided below in Table 4. The adsorption zone switch frequency refers to the frequency at which the adsorbent in an adsorption zone becomes saturated and the adsorption zones must be switched to regenerate the adsorbents. The relative adsorption zone switch frequency for each of Examples 2 and 3 is the adsorption switch frequency divided by the adsorption switch frequency for Example 2.

TABLE 4

| | Example 2 | Example 3 |
|---|---|---|
| Adsorption Process | Solvent-Assisted | Without Solvent |
| Total Product Yield (%) | 98 | 95 |
| LHSV ($hr^{-1}$) | 8 | 6 |
| Adsorption zone switch frequency | 1 | 2.5 |

As shown in Table 4, if no light paraffin solvent is added to the greater boiling hydrotreated effluent (>540° C. fraction) to dilute and reduce the viscosity of the greater boiling hydrotreated effluent, then more oil molecules are adsorbed on the adsorbents, which reduces the overall total yield and increases the adsorption zone switch rate by a factor of about 2.5. Thus, the process of Example 2 comprising the solvent-assisted adsorption of asphaltenes can increase the yield and decrease the adsorption zone switch frequency. Furthermore, addition of the light paraffin solvent can help the separation and fast settling of the asphaltene compounds from the heavy oil of the greater boiling hydrotreated effluent. As a result, the resident time in the adsorption zones can be shortened, as indicated by the greater LHSV for Example 2.

A first aspect of the present disclosure is directed to a process for upgrading a hydrocarbon feed. The process comprises hydrotreating the hydrocarbon feed to produce a hydrotreated effluent. The hydrotreated effluent can comprise asphaltenes, coke precursors, or both. The process further comprises separating the hydrotreated effluent into a lesser boiling hydrotreated effluent and a greater boiling hydrotreated effluent, where the greater boiling hydrotreated effluent can comprise the asphaltenes, coke precursors, or both. The process further comprises combining the greater boiling hydrotreated effluent with a light paraffin solvent to produce a combined stream, where the light paraffin solvent can reduce solubility of the asphaltenes in the combined stream and reduce the viscosity of the combined stream. The process can further include adsorbing at least a portion of the asphaltenes, coke precursors, or both from the combined stream to produce an adsorption effluent and hydrocracking the lesser boiling hydrotreated effluent and at least a portion of the adsorption effluent to produce a hydrocracked effluent comprising a greater concentration of hydrocarbons having boiling point temperatures less than 180° C. compared to the hydrotreated effluent.

A second aspect of the present disclosure may include the first aspect, where the hydrocarbon feed can comprise a whole crude, a de-salted whole crude, or a combination of these materials.

A third aspect of the present disclosure may include either one of the first or second aspects, where the greater boiling hydrotreated effluent can comprise constituents of the hydrotreated effluent having boiling point temperatures greater than or equal to 540° C.

A fourth aspect of the present disclosure may include any one of the first through third aspects, where the lesser boiling hydrotreated effluent can be substantially free of asphaltenes, such as having less than or equal to 0.01 wt. % asphaltenes based on the total weight of the lesser boiling hydrotreated effluent.

A fifth aspect of the present disclosure may include any one of the first through fourth aspects, comprising passing the lesser boiling hydrotreated effluent directly from separating to hydrocracking without being subjected to the adsorbing.

A sixth aspect of the present disclosure may include any one of the first through fifth aspects, where the light paraffin solvent can comprise, consists of, or consists essentially of saturated hydrocarbons having from 3 to 7 carbon atoms, such as having greater than or equal to 90 wt. %, greater than or equal to 95 wt. %, or even greater than or equal to 98 wt. % saturated hydrocarbons having from 3 to 7 carbon atoms based on the total weight of the light paraffin solvent.

A seventh aspect of the present disclosure may include any one of the first through sixth aspects, where the light paraffin solvent can be a solvent in which the asphaltenes are not soluble.

An eighth aspect of the present disclosure may include any one of the first through seventh aspects, where combining the greater boiling hydrotreated effluent with the light paraffin solvent can comprise passing the greater boiling hydrotreated effluent and the light paraffin solvent to a solvent mixing vessel that is a continuous stirred tank reactor.

A ninth aspect of the present disclosure may include any one of the first through seventh aspects, comprising combining the greater boiling hydrotreated effluent with the light paraffin solvent in-line before the adsorbing.

A tenth aspect of the present disclosure may include any one of the first through ninth aspects, where adsorbing the at least a portion of the asphaltenes, coke precursors, or both can comprise contacting the combined stream with an adsorbent, where contact with the adsorbent can cause at least a portion of the asphaltene, coke precursors, or both to adsorb onto the adsorbent.

An eleventh aspect of the present disclosure may include the tenth aspect, where the adsorbent can include at least one of spherical alumina, clay, metal nanoparticles, or combinations of these.

A twelfth aspect of the present disclosure may include either one of the tenth or eleventh aspects, further comprising regenerating the adsorbent by contacting the adsorbent with an asphaltene dissolving solvent capable of dissolving asphaltenes, coke precursors, or both.

A thirteenth aspect of the present disclosure may include any one of the first through twelfth aspects, where the adsorption effluent can have a concentration of asphaltenes, coke precursors, or both that is less than a concentration of asphaltenes, coke precursors, or both in the combined stream.

A fourteenth aspect of the present disclosure may include any one of the first through thirteenth aspects, comprising adsorbing at least 90 percent by weight, or at least 95 percent by weight of the asphaltenes, coke precursors, or both, from the combined stream.

A fifteenth aspect of the present disclosure may include any one of the first through fourteenth aspects, further comprising recovering at least a portion of the light paraffin solvent and recycling the at least a portion of the light paraffin solvent back into combination with the greater boiling hydrotreated effluent.

A sixteenth aspect of the present disclosure may include the fifteenth aspect, where recovering the at least a portion of the light paraffin solvent can comprise passing the adsorption effluent to an adsorption effluent separator that separates the adsorption effluent into a greater boiling adsorption effluent and a recovered light paraffin solvent.

A seventeenth aspect of the present disclosure may include the sixteenth aspect, where the adsorption effluent separator can separate the adsorption effluent by flashing off the recovered light paraffin solvent.

An eighteenth aspect of the present disclosure may include the fifteenth aspect, where recovering the at least a portion of the light paraffin solvent can comprise passing the hydrocracked effluent to a hydrocracked effluent separation system that can separate the hydrocracked effluent to produce a recovered light paraffin solvent and one or more product streams, such as one or more liquid product streams, one or more gaseous product streams, or combinations thereof.

A nineteenth aspect of the present disclosure may include any one of the first through eighteenth aspects, further comprising separating the hydrocracked effluent into one or more gaseous product streams, one or more liquid product streams, or combinations of these.

A twentieth aspect of the present disclosure may include any one of the first through nineteenth aspects, where hydrotreating can comprise contacting the hydrocarbon feed with hydrogen in the presence of at least one hydrotreating catalyst in at least one hydrotreating zone.

A twenty-first aspect of the present disclosure may include any one of the first through twentieth aspects, where hydrotreating can remove one or more metals, nitrogen compounds, sulfur compounds, or combinations of these.

A twenty-second aspect of the present disclosure may include any one of the first through twenty-first aspects, comprising combining the lesser boiling hydrotreated effluent and the adsorption effluent to produce a hydrocracker feed and passing the hydrocracker feed to the hydrocracking unit.

A twenty-third aspect of the present disclosure may include the twenty-second aspect, where hydrocracking can comprise contacting the hydrocracker feed with hydrogen in the presence of a hydrocracking catalyst to produce the hydrocracked effluent, where the hydrocracked effluent can have a greater concentration of hydrocarbons having boiling point temperatures less than or equal to 180° C. compared to the hydrocracker feed.

A twenty-fourth aspect of the present disclosure is directed to a system for upgrading hydrocarbons, the system comprising a hydrotreating unit comprising at least one hydrotreating catalyst, where the hydrotreating unit is configured to contact a hydrocarbon feed with hydrogen in the presence of the at least one hydrotreating catalyst. The contacting upgrades the hydrocarbon feed to produce a hydrotreated effluent having a reduced concentration of at least one of nitrogen, sulfur, metals, or combinations of these. The system further comprises a hydrotreated effluent separator that is configured to separate the hydrotreated effluent into a lesser boiling hydrotreated effluent and a greater boiling hydrotreated effluent, a light paraffin solvent stream in fluid communication with the greater boiling hydrotreated effluent, and an adsorption unit downstream of the hydrotreating unit. The adsorption unit is configured to contact a combined stream comprising a mixture of the greater boiling hydrotreated effluent and the light paraffin solvent stream with an adsorbent capable of adsorbing asphaltenes, coke precursors, or both from the combined stream. The system further comprises a hydrocracking unit disposed downstream of the hydrotreating unit and the adsorption unit. The hydrocracking unit comprises a hydrocracking catalyst, and the hydrocracking unit can be configured to contact a hydrocracker feed with hydrogen in the presence of the hydrocracking catalyst at conditions sufficient to convert at least a portion of the hydrocracker feed to produce a hydrocracked effluent comprising hydrocarbons having a boiling point temperature less than or equal to 180° C. The hydrocracker feed can comprise the lesser boiling hydrotreated effluent and at least a portion of an adsorption effluent from the adsorption unit.

A twenty-fifth aspect of the present disclosure may include the twenty-fourth aspect, further comprising the hydrocarbon feed, wherein the hydrocarbon feed can comprise a crude oil, a desalted crude oil, or combinations thereof.

A twenty-sixth aspect of the present disclosure may include the twenty-fifth aspect, further comprising a hydrocarbon feed source directly fluidly coupled to an inlet of the hydrotreating unit to pass the hydrocarbon feed directly from the hydrocarbon feed source to the hydrotreating unit.

A twenty-seventh aspect of the present disclosure may include any one of the twenty-fourth through twenty-sixth aspects, further comprising a solvent mixing vessel disposed downstream of the hydrotreated effluent separator, where the solvent mixing vessel can be configured to combine the greater boiling hydrotreated effluent and the light paraffin solvent to produce the combined stream.

A twenty-eighth aspect of the present disclosure may include any one of the twenty-fourth through twenty-seventh aspects, further comprising an adsorption effluent separator disposed directly downstream of the adsorption unit. The adsorption effluent separator can be configured to separate the adsorption effluent into recovered light paraffin solvent and a greater boiling adsorption effluent. The adsorption effluent separator can be in fluid communication with the hydrocracking unit to pass the greater boiling adsorption effluent to the hydrocracking unit.

A twenty-ninth aspect of the present disclosure may include the twenty-eighth aspect, further comprising a light paraffin solvent recycle line fluidly coupling the adsorption effluent separator and the greater boiling hydrotreated effluent, where the light paraffin solvent recycle line can be configured to pass the recovered light paraffin solvent from the adsorption effluent separator back to be combined with the greater boiling hydrotreated effluent upstream of the adsorption unit.

A thirtieth aspect of the present disclosure may include any one of the twenty-fourth through twenty-ninth aspects, further comprising a hydrocracked effluent separation system downstream of the hydrocracking unit, where the hydrocracked effluent separation system can be configured to separate the hydrocracked effluent into at least one gaseous product stream and at least one liquid product stream.

A thirty-first aspect of the present disclosure may include the thirtieth aspect, where the hydrocracked effluent separation system can be configured to separate the hydrocracked effluent into the at least one gaseous product stream, the at least one liquid product stream, and a recovered light paraffin solvent.

A thirty-second aspect of the present disclosure may include the thirty-first aspect, further comprising a light paraffin solvent recycle line fluidly coupling the hydrocracked effluent separation system with the greater boiling hydrotreated effluent to pass the recovered light paraffin solvent back into combination with the greater boiling hydrotreated effluent.

A thirty-third aspect of the present disclosure may include any one of the twenty-fourth through thirty-second aspects, where the hydrotreating catalyst can comprise at least one of a desulfurization catalyst, a transition catalyst, a denitrogenation catalyst, a demetalization catalyst, a de-aromatization catalyst, or combinations of these.

A thirty-fourth aspect of the present disclosure may include any one of the twenty-fourth through thirty-third aspects, where the hydrotreating unit can comprise a desulfurization reaction zone comprising a desulfurization catalyst, a transition reaction zone comprising a transition catalyst, and a demetalization reaction zone comprising at demetalization catalyst.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A process for upgrading a hydrocarbon feed, the process comprising:

hydrotreating the hydrocarbon feed to produce a hydrotreated effluent, where the hydrotreated effluent comprises asphaltenes, coke precursors, or both;

separating the hydrotreated effluent into a lesser boiling hydrotreated effluent and a greater boiling hydrotreated effluent, where the greater boiling hydrotreated effluent comprises the asphaltenes, coke precursors, or both;

combining the greater boiling hydrotreated effluent with a light paraffin solvent to produce a combined stream, where the light paraffin solvent reduces solubility of the asphaltenes in the combined stream and reduces the viscosity of the combined stream;

adsorbing at least a portion of the asphaltenes, coke precursors, or both from the combined stream to produce an adsorption effluent; and hydrocracking the lesser boiling hydrotreated effluent and at least a portion of the adsorption effluent to produce a hydrocracked effluent comprising a greater concentration of hydrocarbons having boiling point temperatures less than 180° C. compared to the hydrotreated effluent.

2. The process of claim 1, where the hydrocarbon feed comprises a whole crude, a de-salted whole crude, or a combination thereof.

3. The process of claim 1, where the greater boiling hydrotreated effluent comprises constituents of the hydrotreated effluent having boiling point temperatures greater than or equal to 540° C.

4. The process of claim 1, comprising passing the lesser boiling hydrotreated effluent directly from separating to hydrocracking without being subjected to the adsorbing.

5. The process of claim 1, where the light paraffin solvent comprises saturated hydrocarbons having from 3 to 7 carbon atoms.

6. The process of claim 1, where combining the greater boiling hydrotreated effluent with the light paraffin solvent comprises passing the greater boiling hydrotreated effluent and the light paraffin solvent to a solvent mixing vessel that is a continuous stirred tank reactor or combining the greater boiling hydrotreated effluent with the light paraffin solvent in-line before the adsorbing.

7. The process of claim 1, where adsorbing the at least a portion of the asphaltenes, coke precursors, or both comprises contacting the combined stream with an adsorbent, where contact with the adsorbent causes at least a portion of the asphaltene, coke precursors, or both to adsorb onto the adsorbent.

8. The process of claim 7, where the adsorbent includes at least one of spherical alumina, clay, metal nanoparticles, or combinations of these.

9. The process of claim 7, further comprising regenerating the adsorbent by contacting the adsorbent with an asphaltene dissolving solvent capable of dissolving asphaltenes, coke precursors, or both.

10. The process of claim 1, further comprising recovering at least a portion of the light paraffin solvent and recycling the at least a portion of the light paraffin solvent back into combination with the greater boiling hydrotreated effluent.

11. The process of claim 10, where recovering the at least a portion of the light paraffin solvent comprises passing the adsorption effluent to an adsorption effluent separator that separates the adsorption effluent into a greater boiling adsorption effluent and a recovered light paraffin solvent.

12. The process of claim 11, where the adsorption effluent separator separates the adsorption effluent by flashing off the recovered light paraffin solvent.

13. The process of claim 10, where recovering the at least a portion of the light paraffin solvent comprises passing the hydrocracked effluent to a hydrocracked effluent separation system that separates the hydrocracked effluent to produce a recovered light paraffin solvent and one or more product streams.

14. The process of claim 1, further comprising separating the hydrocracked effluent into one or more gaseous product streams, one or more liquid product streams, or combinations of these.

15. The process of claim 1, comprising:

combining the lesser boiling hydrotreated effluent and the adsorption effluent to produce a hydrocracker feed; and passing the hydrocracker feed to the hydrocracking unit.

16. A system for upgrading hydrocarbons, the system comprising:

a hydrotreating unit comprising at least one hydrotreating catalyst, the hydrotreating unit operable to contact a hydrocarbon feed with hydrogen in the presence of the at least one hydrotreating catalyst, where the contacting upgrades the hydrocarbon feed to produce a hydrotreated effluent having a reduced concentration of at least one of nitrogen, sulfur, metals, or combinations of these;

a hydrotreated effluent separator that separates the hydrotreated effluent into a lesser boiling hydrotreated effluent and a greater boiling hydrotreated effluent;

a light paraffin solvent stream in fluid communication with the greater boiling hydrotreated effluent;

an adsorption unit downstream of the hydrotreating unit, the adsorption unit operable to contact a combined stream comprising a mixture of the greater boiling hydrotreated effluent and the light paraffin solvent stream with an adsorbent capable of adsorbing asphaltenes, coke precursors, or both from the combined stream;

a hydrocracking unit disposed downstream of the hydrotreating unit and the adsorption unit, the hydrocracking unit comprising a hydrocracking catalyst, the hydrocracking unit operable to contact a hydrocracker feed with hydrogen in the presence of the hydrocracking catalyst at conditions sufficient to convert at least a portion of the hydrocracker feed to produce a hydrocracked effluent comprising hydrocarbons having a boiling point temperature less than or equal to 180° C., where the hydrocracker feed comprises the lesser boiling hydrotreated effluent and at least a portion of an adsorption effluent from the adsorption unit.

17. The system of claim 16, further comprising a solvent mixing vessel disposed downstream of the hydrotreated effluent separator, where the solvent mixing vessel is operable to combine the greater boiling hydrotreated effluent and the light paraffin solvent to produce the combined stream.

18. The system of claim 16, further comprising an adsorption effluent separator disposed directly downstream of the adsorption unit, where:

the adsorption effluent separator is configured to separate the adsorption effluent into recovered light paraffin solvent and a greater boiling adsorption effluent; and the adsorption effluent separator is in fluid communication with the hydrocracking unit to pass the greater boiling adsorption effluent to the hydrocracking unit.

19. The system of claim 16, further comprising a hydrocracked effluent separation system downstream of the hydrocracking unit, the hydrocracked effluent separation system operable to separate the hydrocracked effluent into at least one gaseous product stream and at least one liquid product stream.

20. The system of claim 19, where the hydrocracked effluent separation system is operable to separate the hydrocracked effluent into the at least one gaseous product stream, the at least one liquid product stream, and a recovered light paraffin solvent.

* * * * *